US011371279B2

(12) United States Patent
Ege et al.

(10) Patent No.: US 11,371,279 B2
(45) **Date of Patent: *Jun. 28, 2022**

(54) DOOR SKINS, DOORS, AND NESTED DOOR SKINS

(71) Applicant: Masonite Corporation, Tampa, FL (US)

(72) Inventors: Patrick C. Ege, Westmont, IL (US); Dale Di Iulio, Waukesha, WI (US); Timothy D. Gouge, Elgin, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/174,817

(22) Filed: Feb. 12, 2021

(65) Prior Publication Data

US 2021/0164288 A1 Jun. 3, 2021

Related U.S. Application Data

(63) Continuation of application No. 16/747,747, filed on Jan. 21, 2020, now Pat. No. 10,920,481, which is a continuation of application No. 16/510,272, filed on Jul. 12, 2019, now Pat. No. 10,538,955, which is a continuation-in-part of application No. 15/794,404, filed on Oct. 26, 2017, now abandoned.

(51) Int. Cl.

| | |
|---|---|
| ***E06B 3/70*** | (2006.01) |
| ***E06B 3/74*** | (2006.01) |
| ***E06B 3/78*** | (2006.01) |

(52) U.S. Cl.

CPC ..... *E06B 3/7001* (2013.01); *E06B 3/74* (2013.01); *E06B 3/78* (2013.01); *E06B 2003/7023* (2013.01); *E06B 2003/7049* (2013.01)

(58) Field of Classification Search

CPC . E06B 3/7001; E06B 3/74; E06B 3/78; E06B 2003/7023; E06B 2002/7049

See application file for complete search history.

(56) References Cited

U.S. PATENT DOCUMENTS

| | | | |
|---|---|---|---|
| 4,236,365 | A | 12/1980 | Wheeler |
| 5,543,234 | A | 8/1996 | Lynch et al. |
| 5,782,055 | A | 7/1998 | Crittenden |
| 5,887,402 | A | 3/1999 | Ruggie et al. |
| 6,200,687 | B1 | 3/2001 | Smith et al. |
| 6,689,301 | B1 | 2/2004 | Moyes |
| 7,021,015 | B2 | 4/2006 | Lynch |
| 7,022,414 | B2 | 4/2006 | Davina |
| 7,426,806 | B2 | 9/2008 | Lynch et al. |
| 7,721,499 | B2 | 5/2010 | Lynch et al. |

(Continued)

*Primary Examiner* — Beth A Stephan

(74) *Attorney, Agent, or Firm* — Berenato & White, LLC

(57) ABSTRACT

A door skin is provided that includes at least one inner panel, an outer body portion surrounding the at least one inner panel, and at least one contoured portion surrounding the at least one panel and interconnecting the at least one panel to the outer body portion. The at least one contoured portion is recessed from the at least one panel and the outer body portion and includes a center base portion that interconnects with the outer body portion via a first sloping portion and with the panel via a second sloping portion. The first sloping portion includes a first angled portion and a first bump. The second sloping portion includes second and third bumps.

20 Claims, 27 Drawing Sheets

(56) References Cited

U.S. PATENT DOCUMENTS

| | | | | |
|---|---|---|---|---|
| 7,765,768 | B2 | 8/2010 | Liang | |
| 7,823,353 | B2 | 11/2010 | Lynch et al. | |
| 7,897,246 | B2 | 3/2011 | Lynch | |
| 8,530,040 | B2 | 9/2013 | Lynch | |
| 9,284,772 | B2 | 3/2016 | Lynch | |
| 9,534,440 | B2 | 1/2017 | Gouge | |
| 9,657,512 | B2 | 5/2017 | Lynch et al. | |
| 10,538,955 | B2 | 1/2020 | Ege | |
| 10,920,481 | B2 | 2/2021 | Ege | |
| 2001/0026862 | A1 | 10/2001 | Smith | |
| 2004/0035085 | A1 | 2/2004 | Crittenden | |
| 2004/0074186 | A1 | 4/2004 | Lynch et al. | |
| 2004/0231265 | A1 | 11/2004 | Walsh | |
| 2005/0217206 | A1 | 10/2005 | Liang | |
| 2008/0274331 | A1 | 11/2008 | Lynch | |
| 2014/0023836 | A1 | 1/2014 | Lynch | |
| 2019/0195005 | A1 | 6/2019 | Di Iulio | |
| 2019/0234135 | A1* | 8/2019 | Ege | E06B 3/7001 |

* cited by examiner

DOOR SKINS, DOORS, AND NESTED DOOR SKINS

CROSS-REFERENCE TO RELATED APPLICATION(S) AND CLAIM TO PRIORITY

This application is a continuation of U.S. application Ser. No. 16/747,747 filed Jan. 21, 2020, now U.S. Pat. No. 10,920,481, which is a continuation of U.S. application Ser. No. 16/510,272 filed Jul. 12, 2019, now U.S. Pat. No. 10,538,955, which is a continuation-in-part of U.S. patent application Ser. No. 15/794,404 filed Oct. 26, 2017, the complete disclosure of which is incorporated herein by reference and to which priority is claimed.

FIELD OF THE INVENTION

This invention relates door skins, sometimes known as door facings, and in particularly preferred embodiments of the invention door skins made of cellulosic material and a binder resin. This invention also relates to doors including door skins and a doorframe, and to door skins that are configured to be nested or stacked to facilitate shipping and handling.

BACKGROUND

Traditional solid wood doors have become relatively expensive due to raw material costs. A commonplace alternative to traditional solid wood doors in residential and commercial buildings is a door assembly that includes a rectangular doorframe of stiles and rails, and door skins secured to the opposite sides of the doorframe to define a door cavity between the door skins and surrounded by the doorframe. The door skins can be made of, for example, steel, fiberglass composites, cellulosic (e.g., wood) composites such as high density fiberboard (HDF) and medium density fiberboard (MDF), and other materials. Wood grain can be molded or embossed into the exterior surfaces of the door skins. Further, paneling can be formed in the exterior surfaces of the door skins to give an appearance that simulates solid wood products. The door cavity between the door skins typically yet optionally includes one or more core components.

SUMMARY OF THE INVENTION

According to an embodiment of the invention, a door skin is provided that includes at least one inner panel, an outer body portion surrounding the at least one inner panel, and at least one contoured portion surrounding the at least one inner panel and interconnecting the at least one inner panel to the outer body portion. The at least one contoured portion is recessed from the at least one inner panel and the outer body portion and includes a center base portion that interconnects with the outer body portion via a first sloping portion and with the inner panel via a second sloping portion. The first sloping portion includes a first angled portion that is continuous with the outer body and a first bump having a first convex exterior surface that extends convexly continuously from the first angled portion to the center base portion. The second sloping portion includes second and third bumps. The second bump is continuous with the center base portion and has a second convex exterior surface that extends convexly continuously from the center base portion to the third bump. The third bump is continuous with the least one inner panel and has a third convex exterior surface that extends convexly continuously from the second bump to the at least one inner panel.

According to another embodiment of the invention, a door is provided that includes a door frame and at least one door skin secured to the door frame. The door skin includes at least one inner panel, an outer body portion surrounding the at least one inner panel, and at least one contoured portion surrounding the at least one inner panel and interconnecting the at least one inner panel to the outer body portion. The at least one contoured portion is recessed from the at least one inner panel and the outer body portion and includes a center base portion that interconnects with the outer body portion via a first sloping portion and with the inner panel via a second sloping portion. The first sloping portion includes a first angled portion that is continuous with the outer body and a first bump having a first convex exterior surface that extends convexly continuously from the first angled portion to the center base portion. The second sloping portion includes second and third bumps. The second bump is continuous with the center base portion and has a second convex exterior surface that extends convexly continuously from the center base portion to the third bump. The third bump is continuous with the least one inner panel and has a third convex exterior surface that extends convexly continuously from the second bump to the at least one inner panel.

Other aspects of the invention, including door skins, assembled doors, nested and/or stacked door skins, subassemblies, related methods, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF THE EXEMPLARY EMBODIMENTS AND EXEMPLARY METHODS

Figure 1:
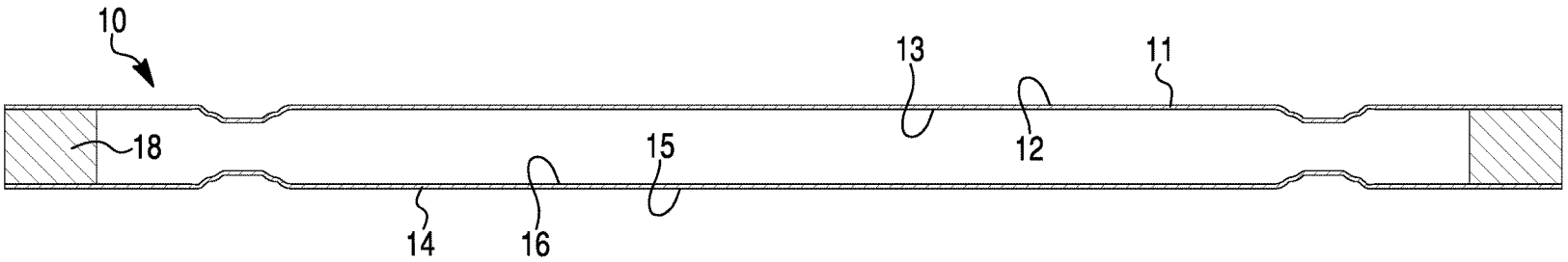
FIG. 1 is a cross-sectional view of a door taken along sectional line 1-1 of FIG. 6 according to an embodiment of the invention.

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods. Like reference numerals designate like parts throughout the drawings.

Referring to FIGS. 1-6, there is illustrated a first embodiment of a single-panel door, generally designated by reference numeral 10, including a first door skin 11 and a second door skin 14. The door skins 11 and 14 may be identical, including having identical profiles and cross sections, as best shown in FIG. 1, by molding (e.g., compression molding) the skins 11, 14 in the same molding apparatus and from the same materials. The first door skin 11 has a first exterior surface 12 and an opposite first interior surface 13. Likewise, the second door skin 14 has a second exterior surface 15 and an opposite second interior surface 16. The first and second exterior surfaces 12 and 15 are opposite or face away from one another. The first and second interior surfaces 13 and 16 face towards one another. Although not shown in FIGS. 1-6, the first and second exterior surfaces 12 and 15 may be molded, embossed, or otherwise provided with a surface pattern or texture, such as a wood grain pattern and/or wood tonal areas that replicate the natural background tones of natural wood. The exterior surfaces 12 and 15 may have one or more coatings, which may include, for example, paint, stain, lacquer, and/or a protective finish. A frame 18 positioned about the periphery of the door skins 11 and 14 contacts and is adhered or otherwise secured to the first and second interior surfaces 13 and 16, typically by an adhesive. Although not shown, a door core may be positioned between the first and second door skins 11 and 14.

The door skins 11 and 14 may be made from wood composite materials such as medium density fiberboard (MDF) or high density fiberboard (HDF), fiberglass-reinforced polymer materials, metal (e.g., steel), or other materials. Preferably, the door skins 11 and 14 are molded wood composite articles made from a cellulosic mat containing a combination of cellulosic fibers and a natural or synthetic binder, such as a phenol formaldehyde or urea formaldehyde resin. The frame 18 may be made of wood, composite materials, metal, or other materials. A door cavity between the door skins 11 and 14 typically yet optionally includes one or more core components (not shown). The core component(s) can be a pre-formed structure or structures, or may be formed in situ, such as by injecting a foam precursor composition into the door cavity and allowing the precursor composition to expand and fill the door cavity with foam.

The making of door skins in general and assembling of doors is known in the art, as described for example in U.S. Pat. No. 5,543,234 to Lynch et al. and U.S. Pat. No. 9,657,512.

Figure 28:
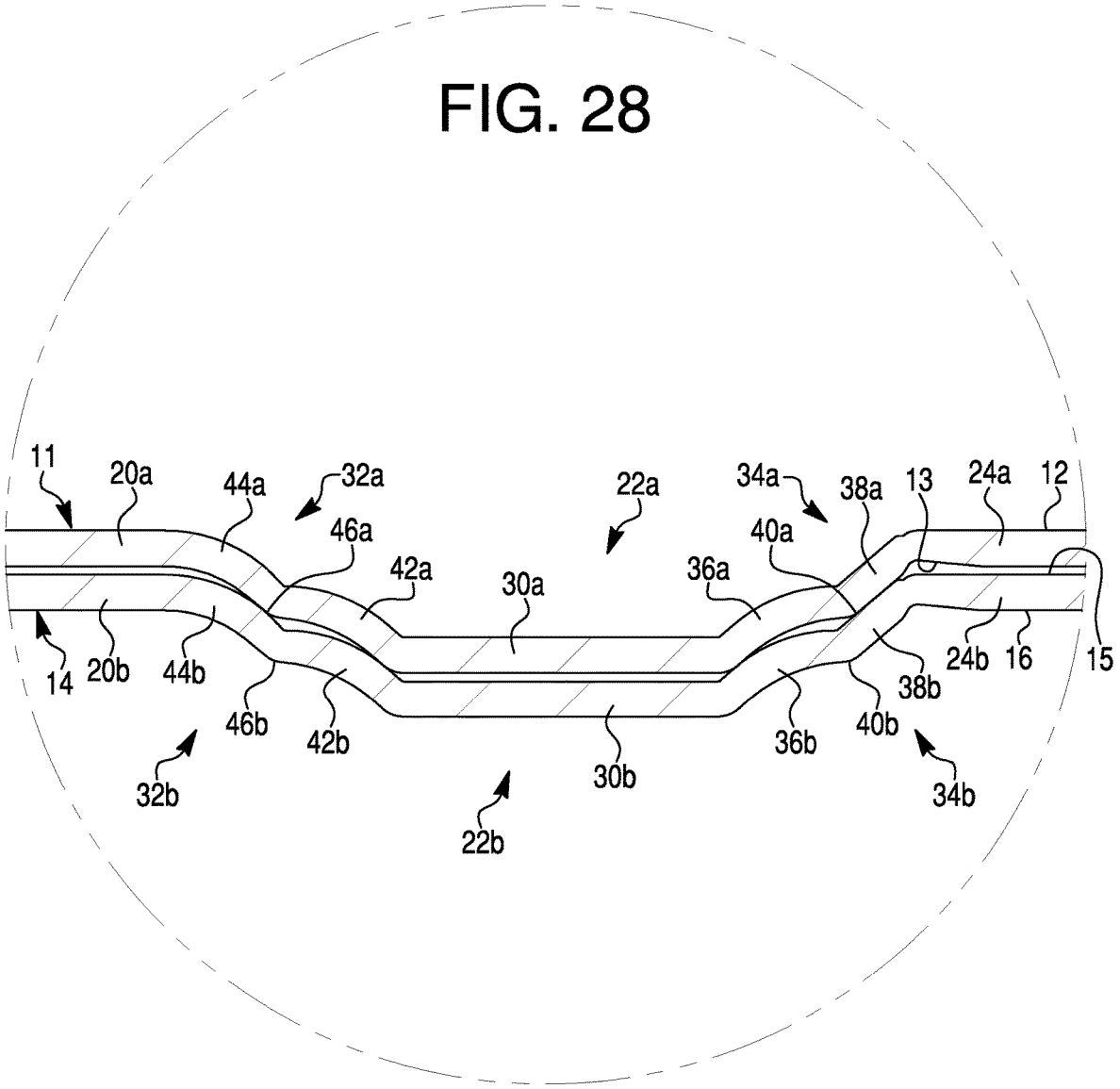
FIG. 28 is an enlarged fragmented view of a sectional profile region of the stacked door skins within the broken-line circle area 28 of FIG. 27.

The first and second door skins 11 and 14 of the first illustrated embodiment of FIGS. 1-6 are each a one-panel skin having an inner panel 20, an outer body portion or outer skirt 24 surrounding the inner panel 20, and a contoured portion or ovalo 22 interconnecting and integrally formed as a unitary piece with the inner panel 20 and the outer body portion 24. When viewed from the exterior side of the door skin 11, the contoured portion 22 defines a continuous depression extending into the planar portions of the exterior surface 12 toward the door core and around the entire periphery of inner panel 20. The contoured portion 22 preferably is continuous and has a uniform cross section, best shown in FIGS. 1 and 2, about its entire periphery. The door skins 11 and 14 each preferably are substantially uniform in thickness, although minor thickness variations may be imparted, as best shown in FIG. 28, discussed below.

Figure 2:
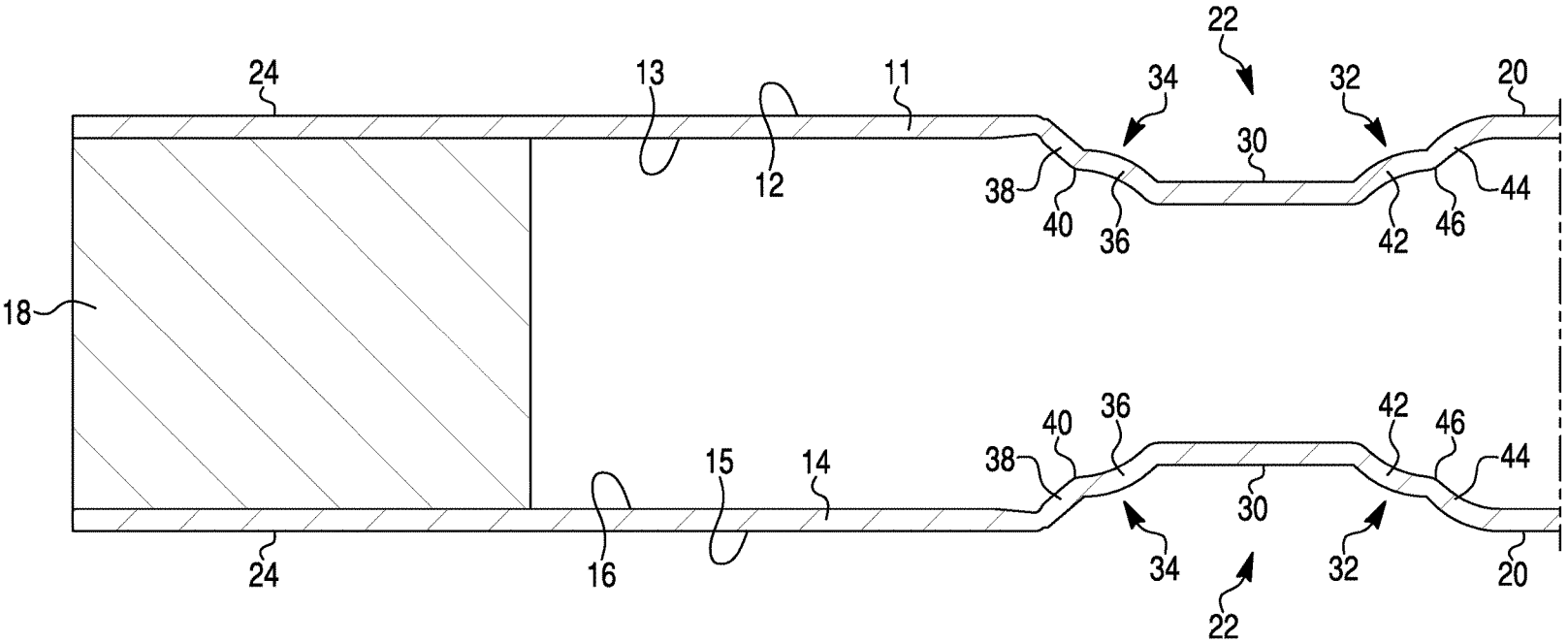
FIG. 2 is an enlarged fragmented view of a sectional profile region of the door of FIG. 1 taken along sectional line 2-2 of FIG. 6.
Figure 3:
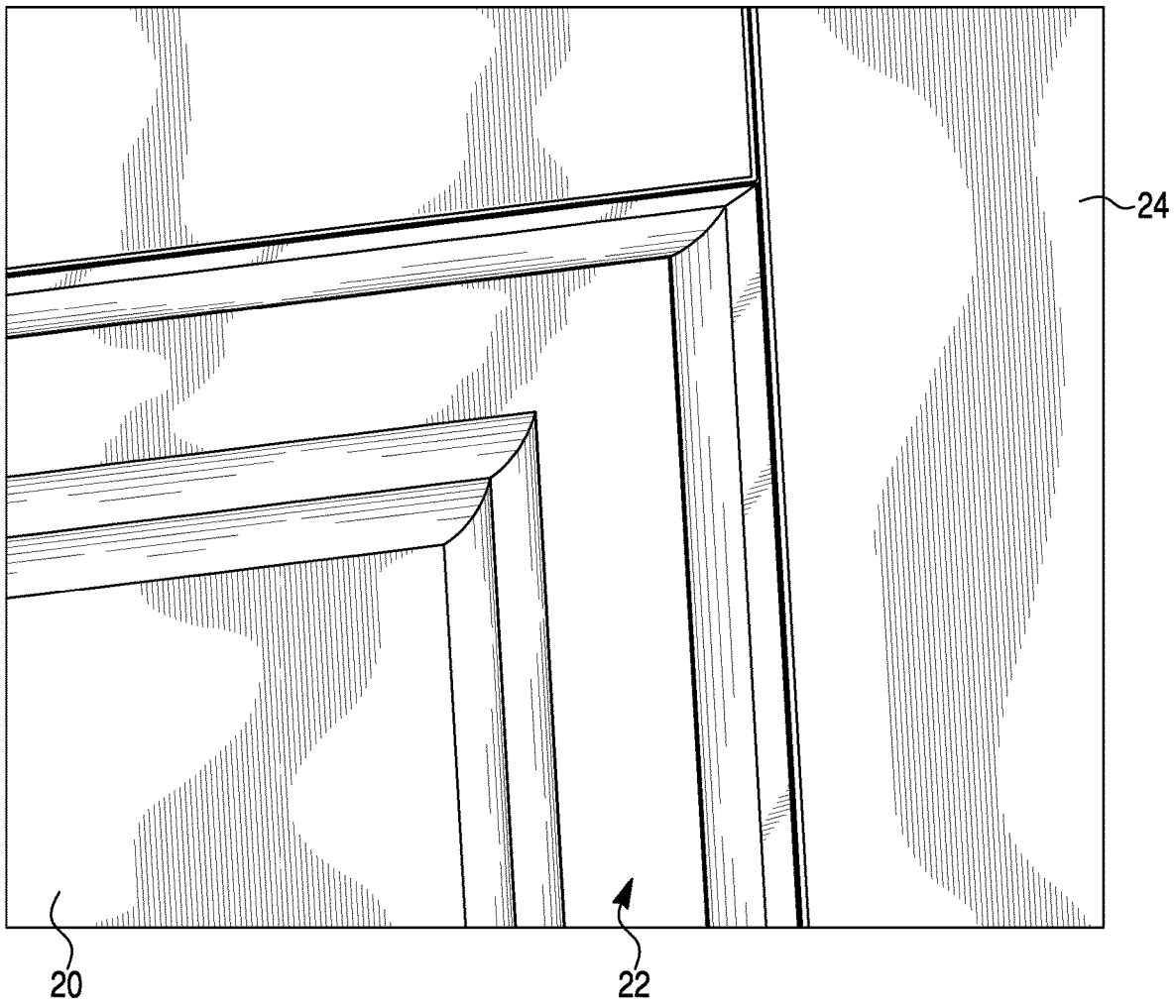
FIG. 3 is an enlarged, fragmented, perspective view of a front exterior surface of a door skin illustrating a panel profile according to the invention.
Figure 4:
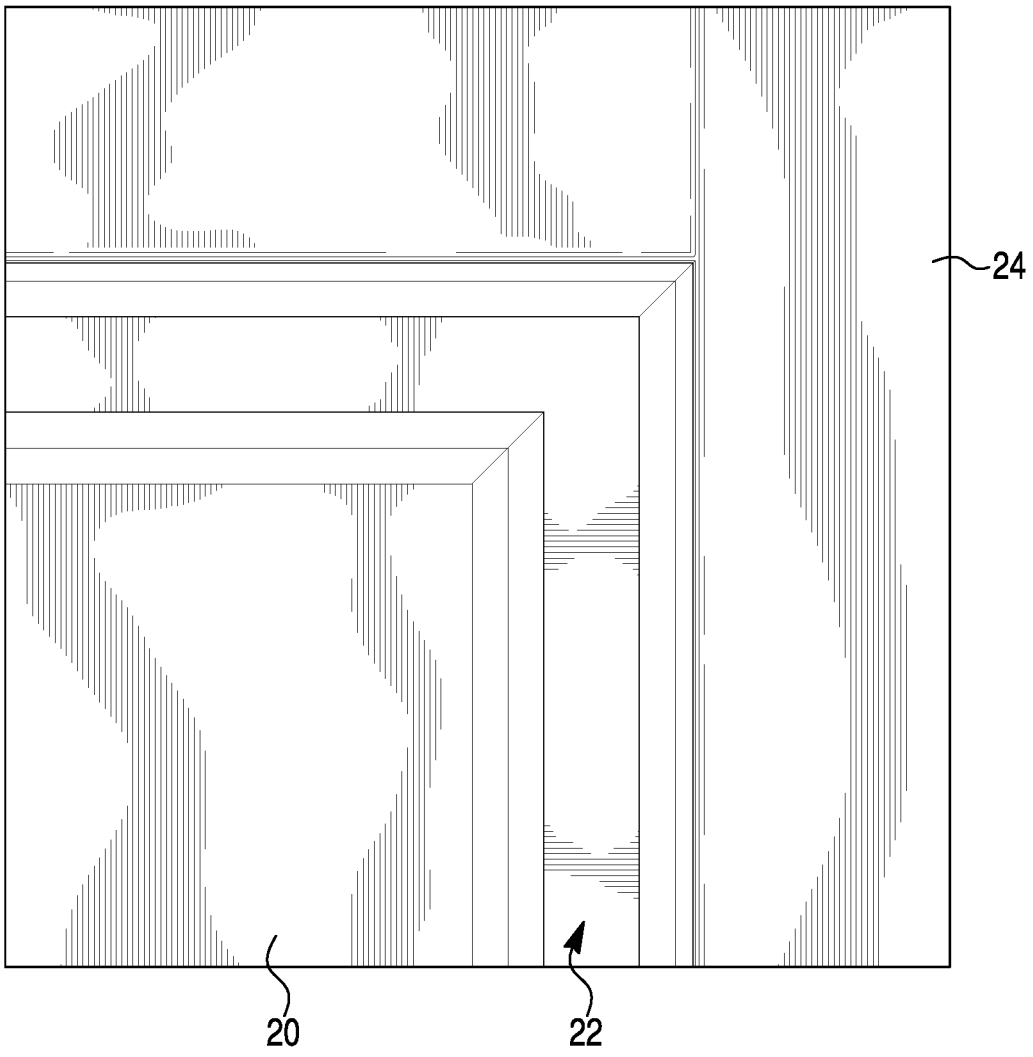
FIG. 4 is an enlarged, fragmented, elevational view of the front exterior surface of the door skin taken within box 4 of FIG. 6.
Figure 5:
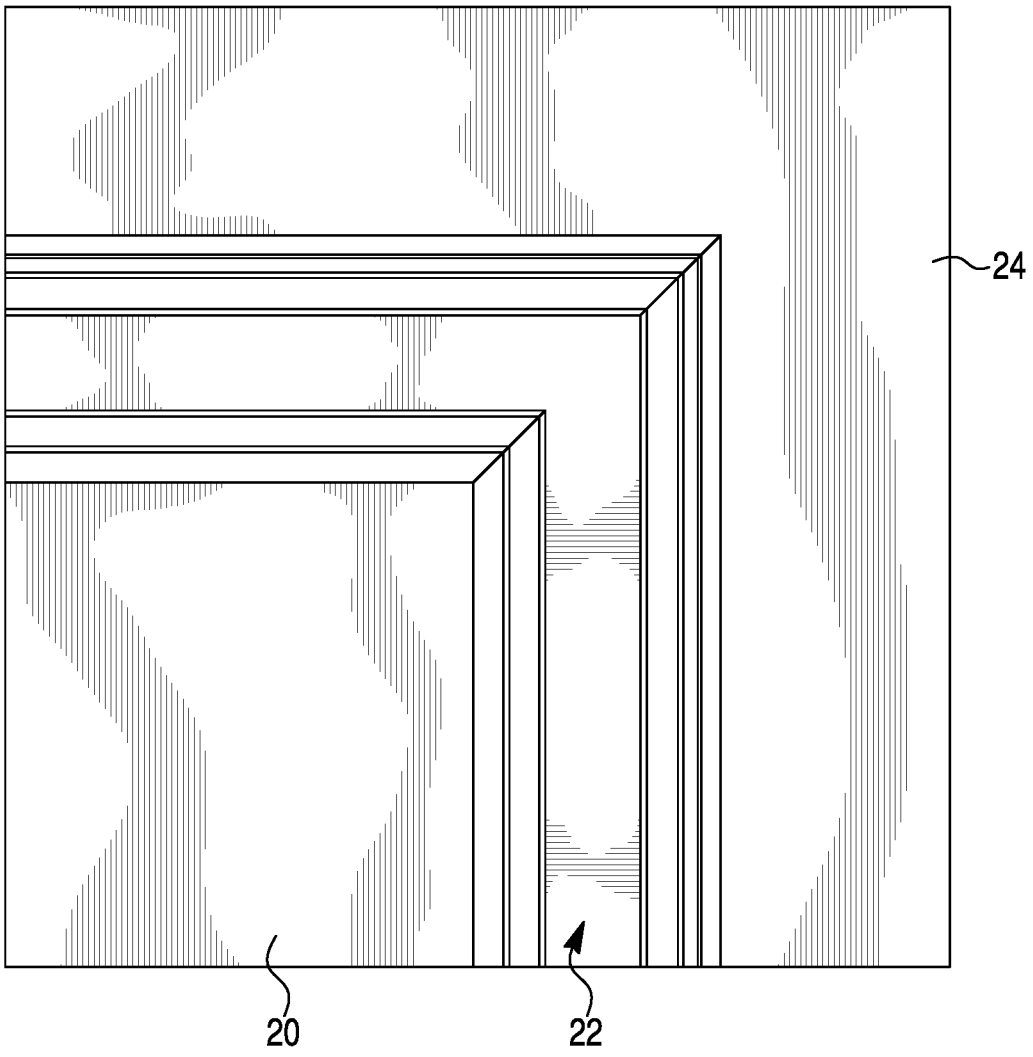
FIG. 5 is an enlarged, fragmented, elevational view of a rear exterior surface of the front exterior surface fragmented view of FIG. 4.

As best shown in FIG. 2, the contoured portions 22 replicate fine millwork. Each contoured portion 22 includes a center base portion 30 recessed from the outer body portion 24 and the inner panel 20. The center base portion 30 is preferably planar and occupies a plane that is parallel to the plane of the outer body portion 24 and the inner panel 20. The exterior surfaces of the outer body portion 24 and the inner panel 20 are preferably coplanar with one another.

The outer side (away from the inner panel 20) of the center base portion 30 is continuous and interconnects with the outer body portion 24 via a first contoured, sloping portion 34 rising from the center base portion 30 to the outer body portion 24. The first sloping portion 34 contains a first bump (or bead) 36 adjacent to the center base portion 30 and an angled portion 38 adjacent to the outer body portion 24. The first bump 36 and the angled portion 38 meet at a V-shaped intersection (or vertex) 40. When viewed from the exterior surface 12, the bump 36 of the first sloping portion 34 forms an upwardly convex protrusion or "bead" that extends convexly continuously from the angled portion 38 to the center base portion 30. The exterior surface 12 of the angled portion 38 is planar.

The inner side (towards the inner panel 20) of the center base portion 30 is continuous and interconnects with the inner panel 20 via a second sloping portion 32 rising from the center base portion 30 to the inner panel 20. The second sloping portion 32 contains a second bump (or bead) 42 adjacent to the center base portion 30 and a third bump (or bead) 44 adjacent to the inner panel 20. The second bump 42 and the third bump 44 meet at a V-shaped intersection (or vertex) 46. When viewed from the exterior surface 12, the second and third bumps 42, 44 of the second sloping portion 32 form upwardly convex protrusions with the V-shaped intersection 46. The exterior surface 12 of the second bump 42 extends convexly continuously from the center base portion 30 to the third bump 44. The exterior surface 12 of the third bump 44 extends convexly continuously from the second bump 42 to the inner panel 20.

Figure 6:
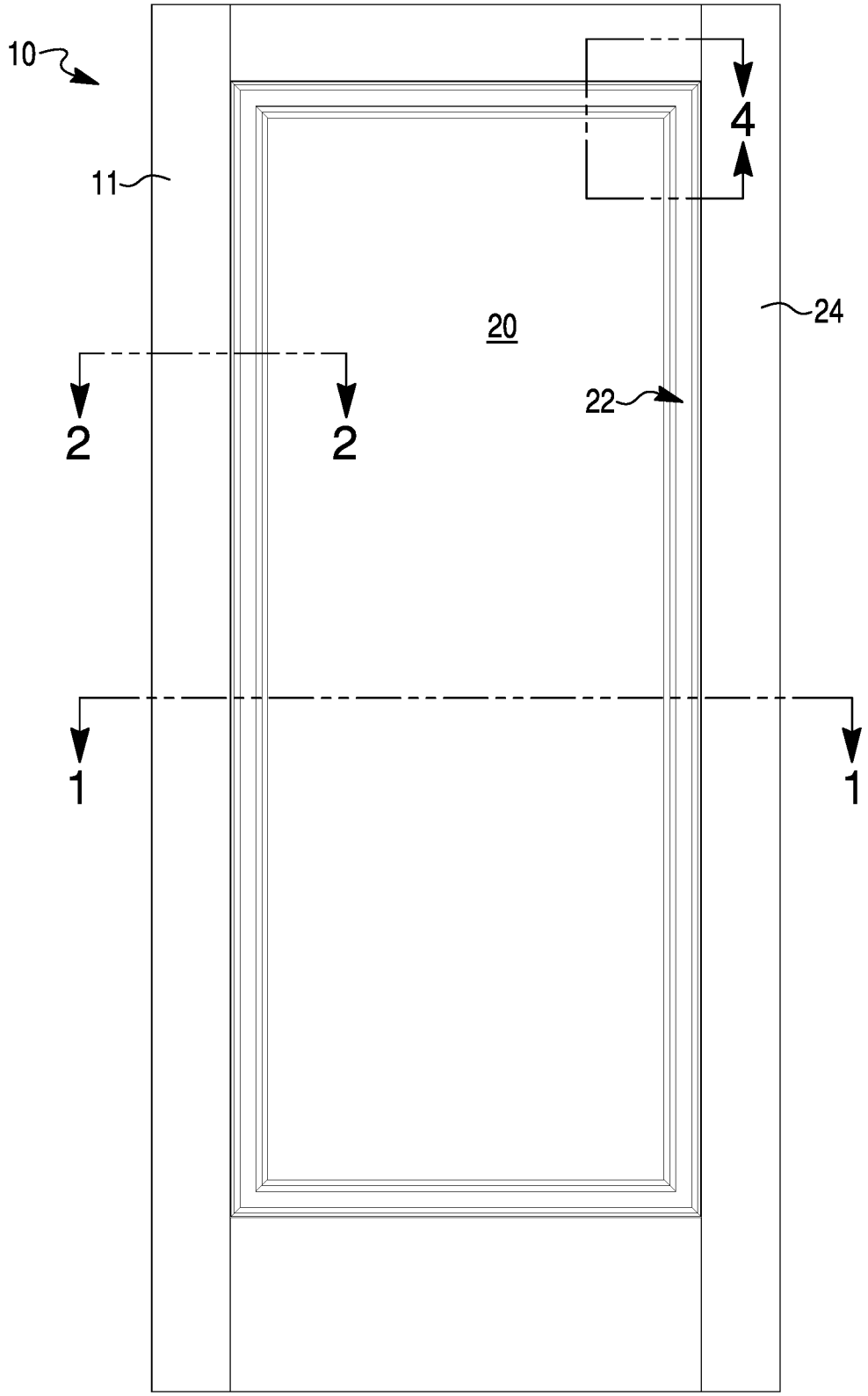
FIG. 6 is a front elevational view of a door skin according to a first embodiment of the invention.
Figure 7:
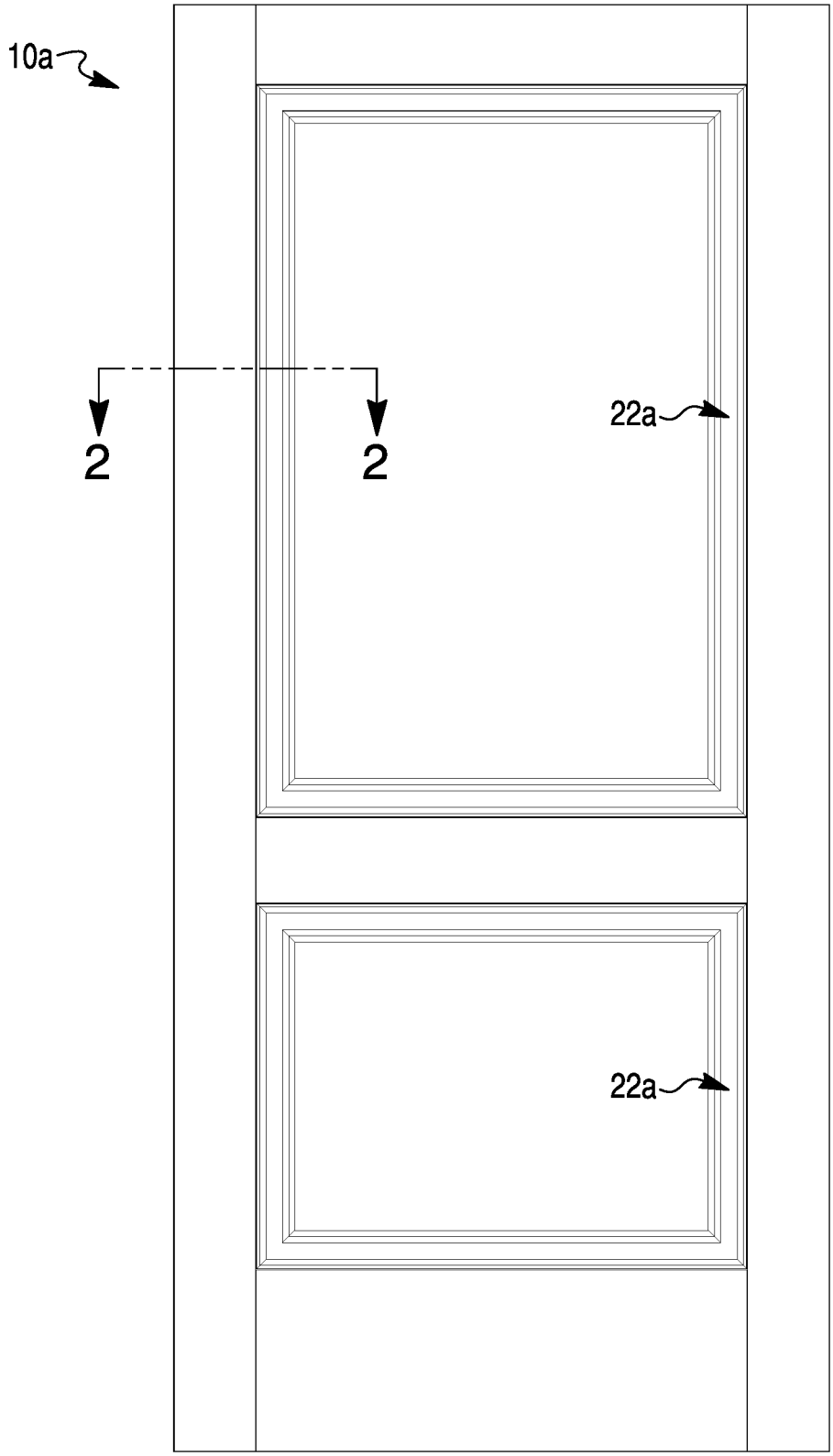
FIG. 7 is a front elevational view of a door skin according to a second embodiment of the invention having a sectional profile region taken along sectional line 2-2 of FIG. 7 that is identical to the sectional profile region of FIG. 2.
Figure 8:
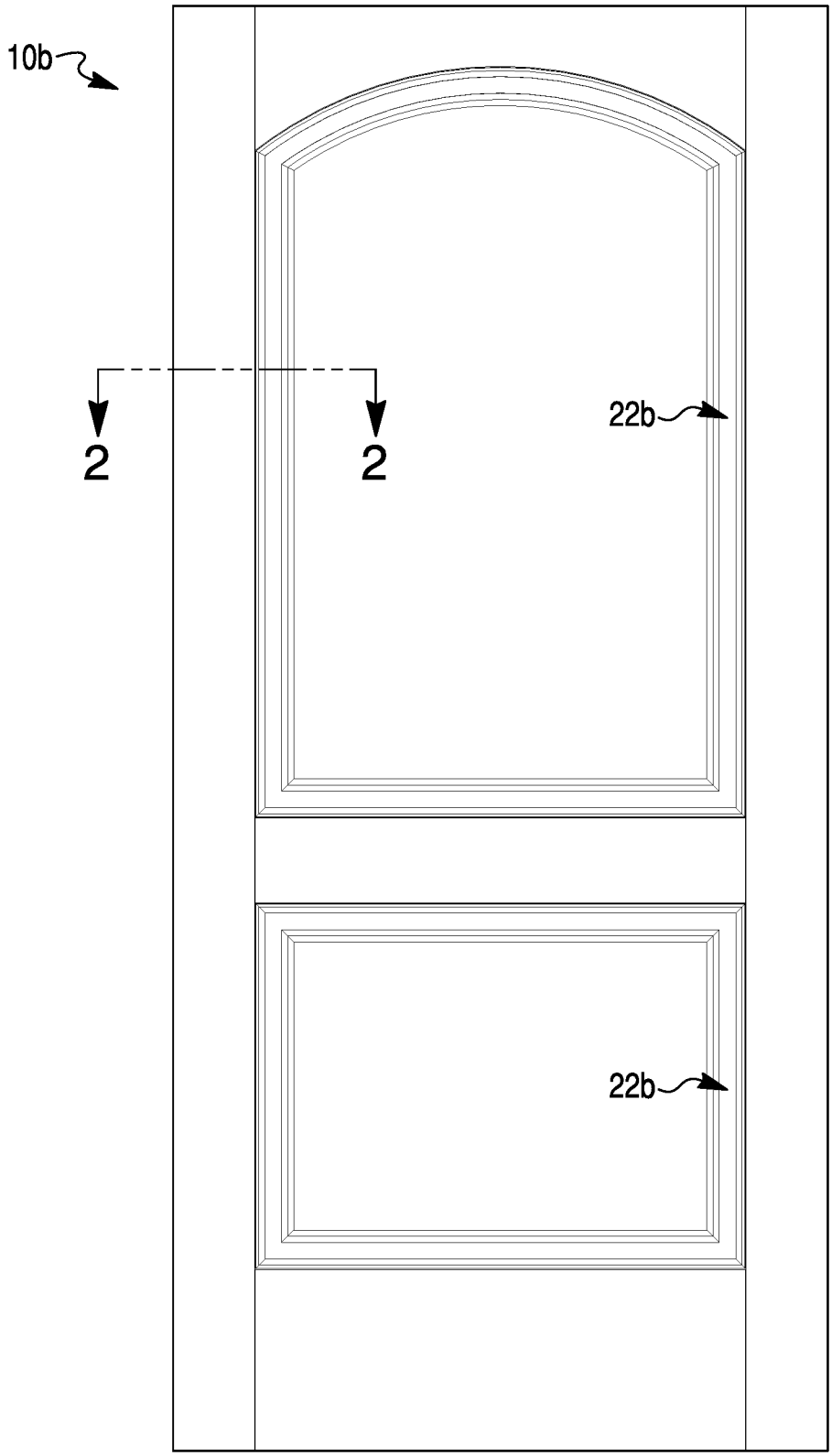
FIG. 8 is a front elevational view of a door skin according to a third embodiment of the invention having a sectional profile region taken along sectional line 2-2 of FIG. 8 that is identical to the sectional profile region of FIG. 2.
Figure 9:
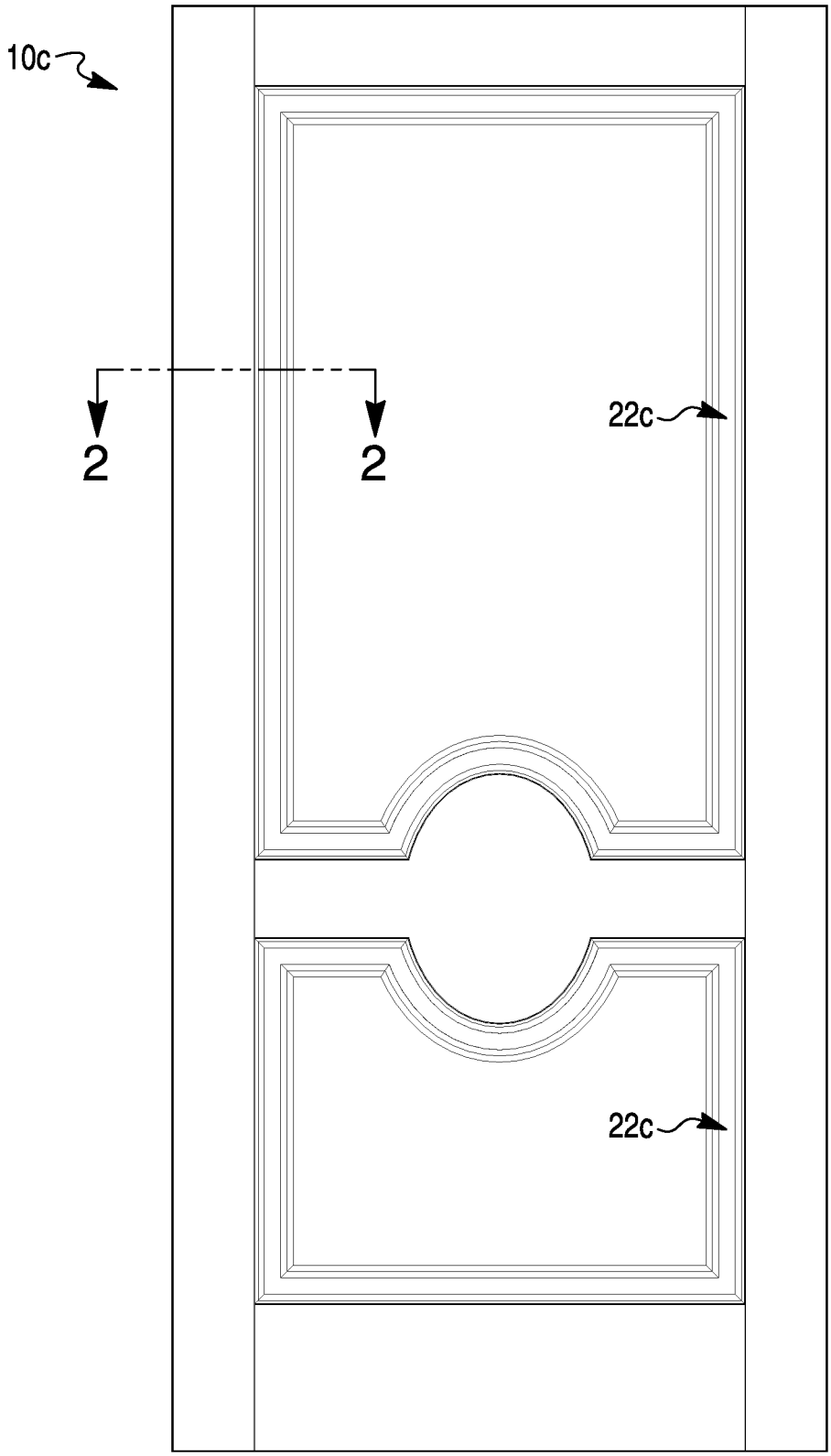
FIG. 9 is a front elevational view of a door skin according to a fourth embodiment of the invention having a sectional profile region taken along sectional line 2-2 of FIG. 9 that is identical to the sectional profile region of FIG. 2.
Figure 10:
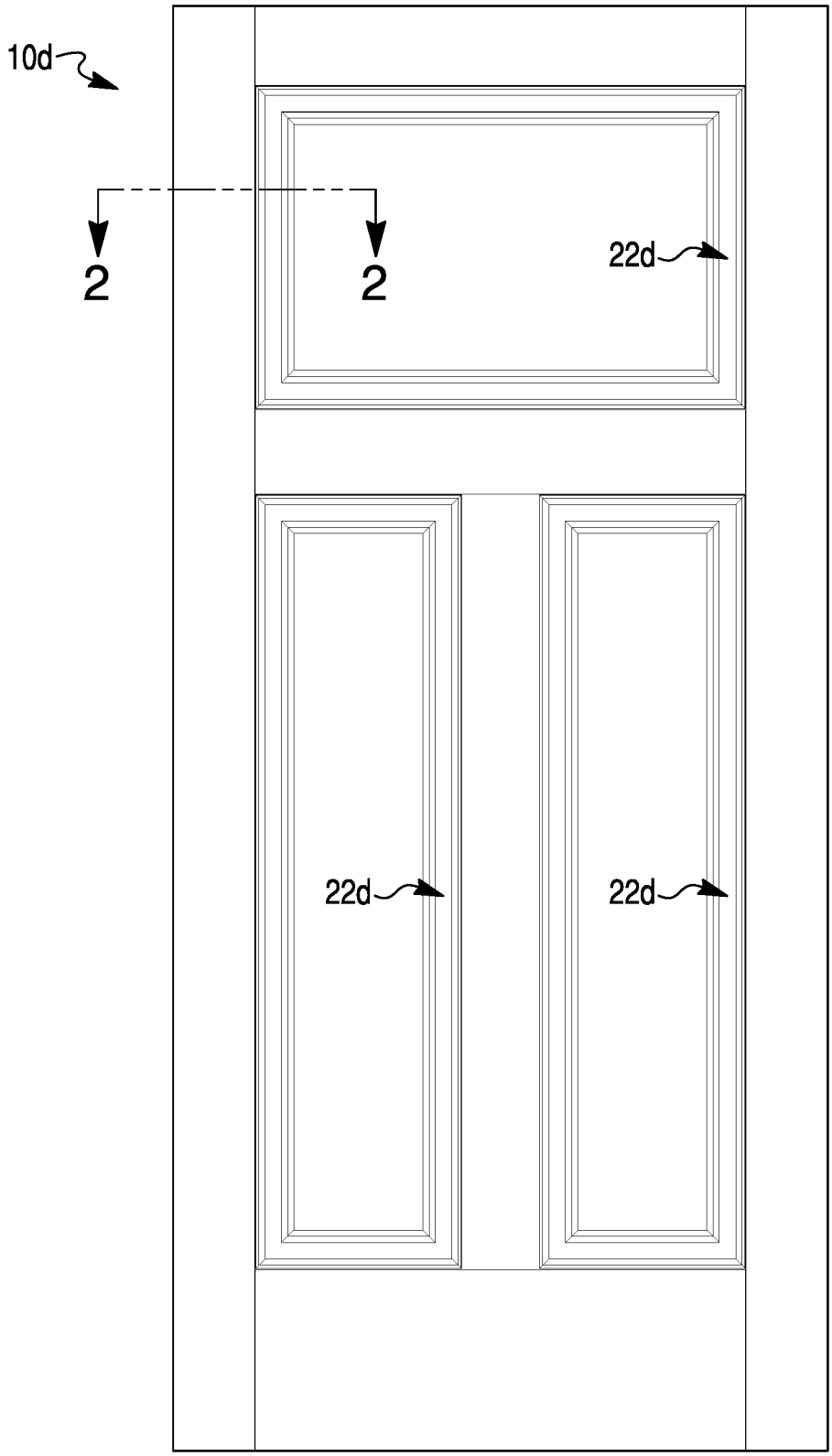
FIG. 10 is a front elevational view of a door skin according to a fifth embodiment of the invention having a sectional profile region taken along sectional line 2-2 of FIG. 10 that is identical to the sectional profile region of FIG. 2.
Figure 11:
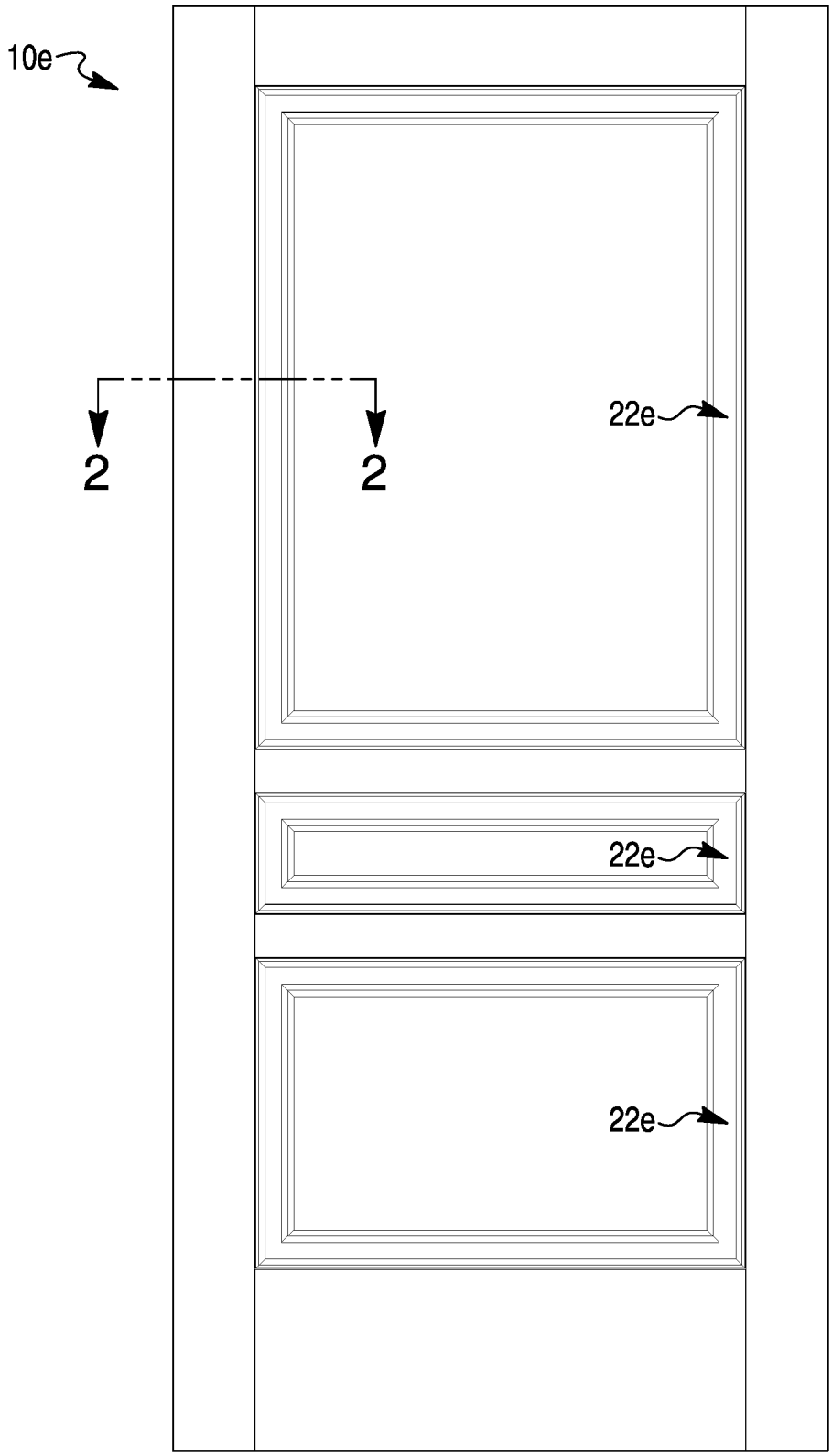
FIG. 11 is a front elevational view of a door skin according to a sixth embodiment of the invention having a sectional profile region taken along sectional line 2-2 of FIG. 11 that is identical to the sectional profile region of FIG. 2.
Figure 12:
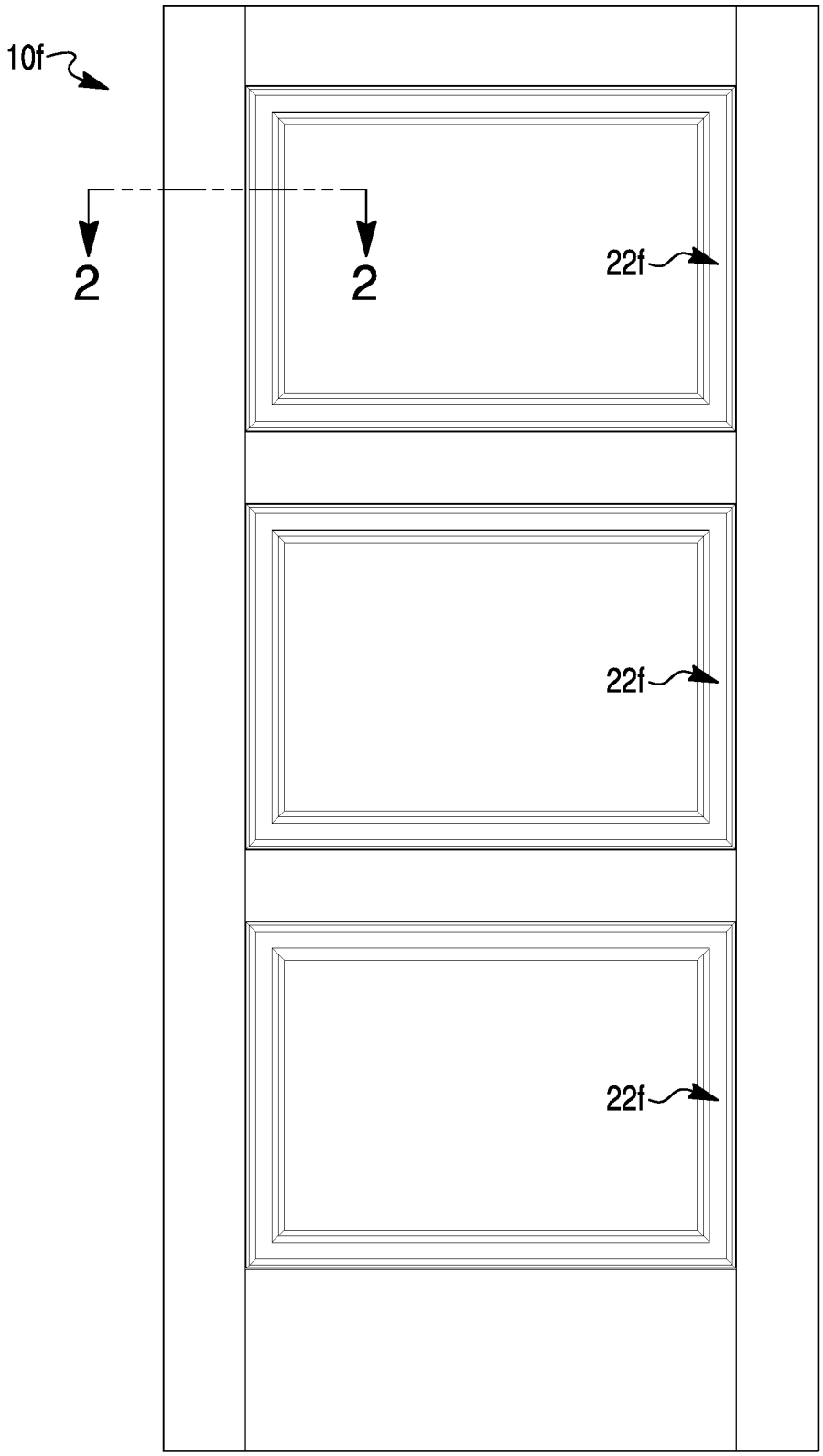
FIG. 12 is a front elevational view of a door skin according to a seventh embodiment of the invention having a sectional profile region taken along sectional line 2-2 of FIG. 12 that is identical to the sectional profile region of FIG. 2.
Figure 13:
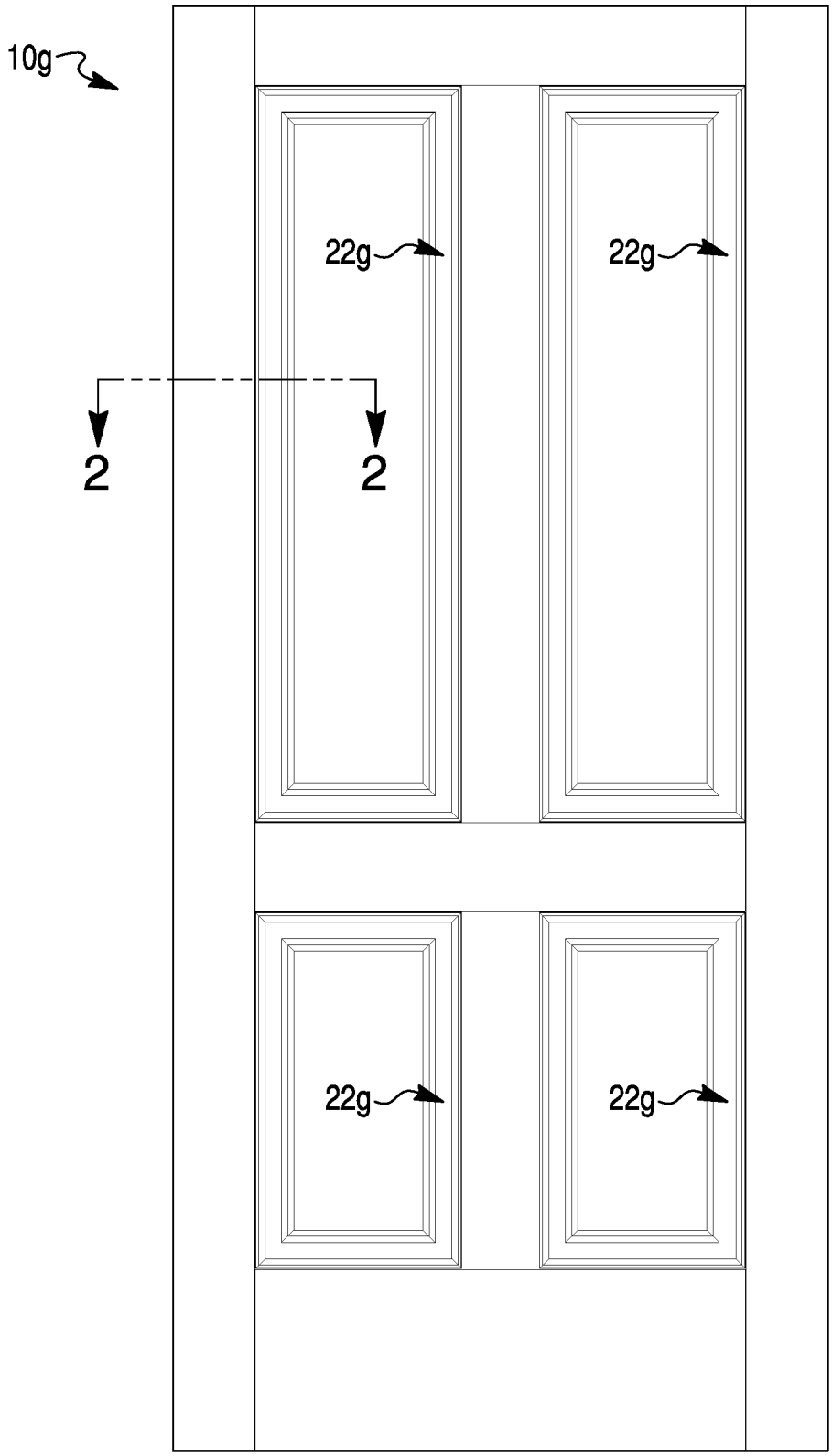
FIG. 13 is a front elevational view of a door skin according to an eighth embodiment of the invention having a sectional profile region taken along sectional line 2-2 of FIG. 13 that is identical to the sectional profile region of FIG. 2.
Figure 14:
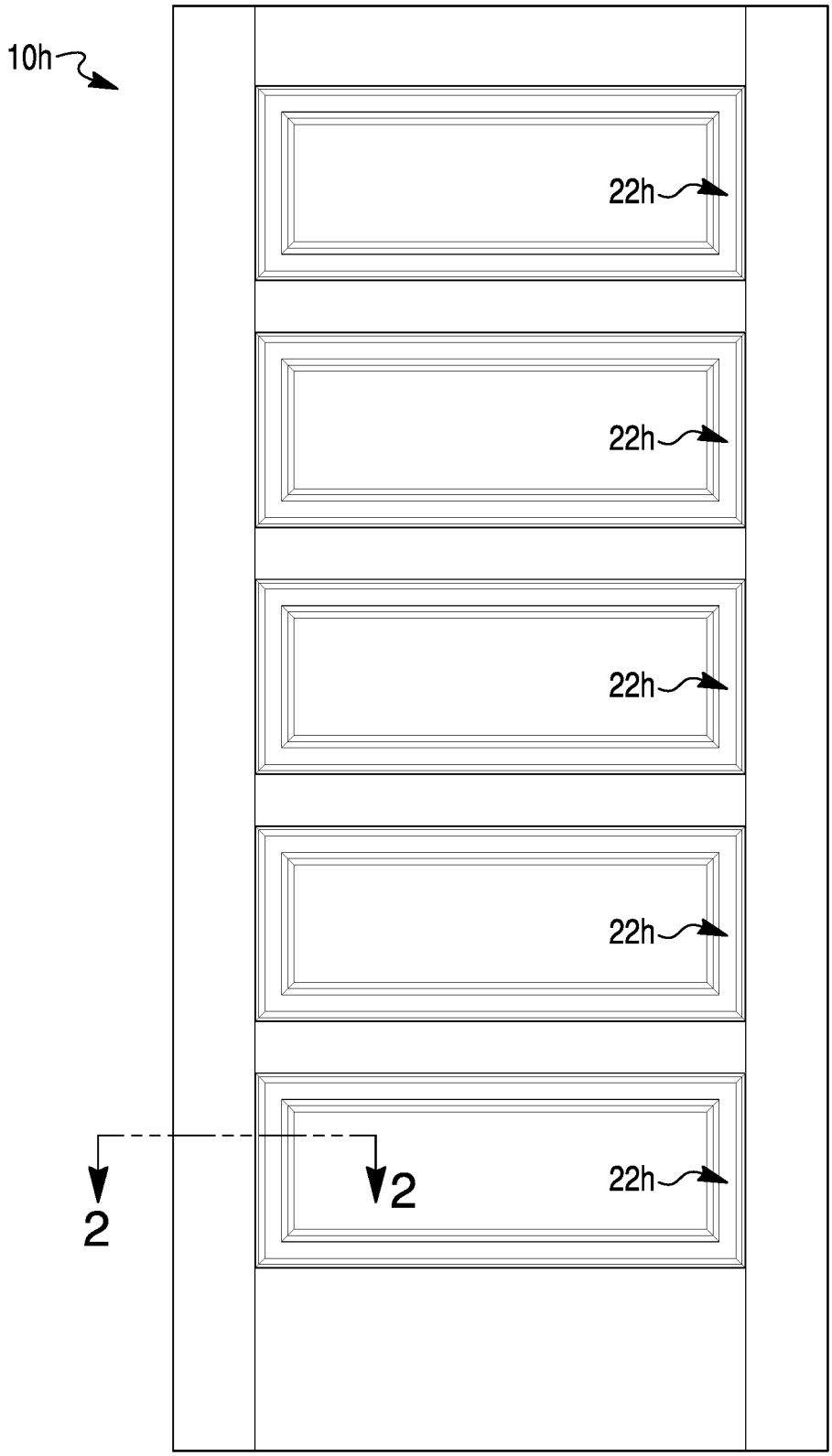
FIG. 14 is a front elevational view of a door skin according to a ninth embodiment of the invention having a sectional profile region taken along sectional line 2-2 of FIG. 14 that is identical to the sectional profile region of FIG. 2.
Figure 15:
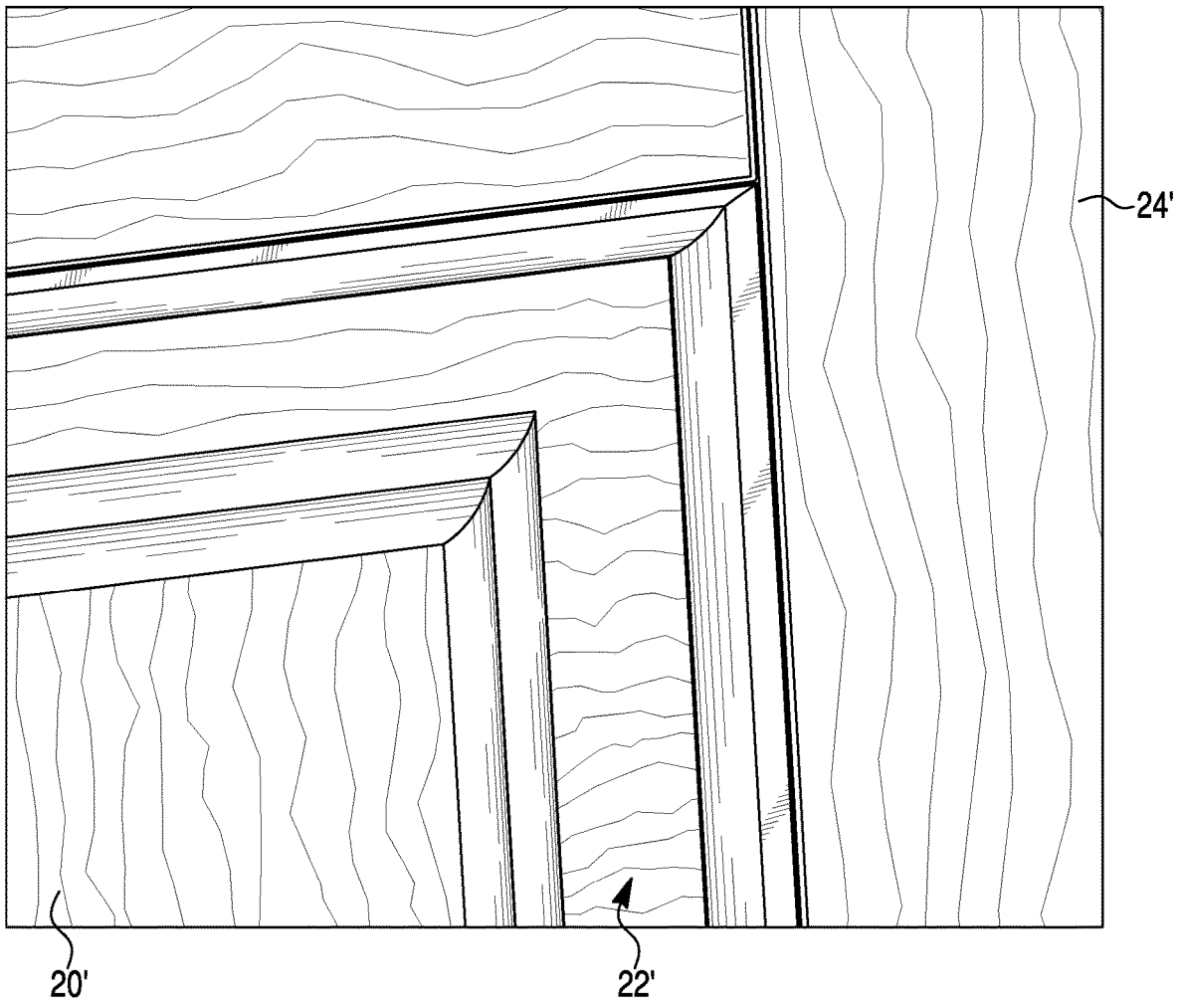
FIG. 15 is an enlarged, fragmented, perspective view of a front exterior surface of a door skin having a wood grain appearance.
Figure 16:
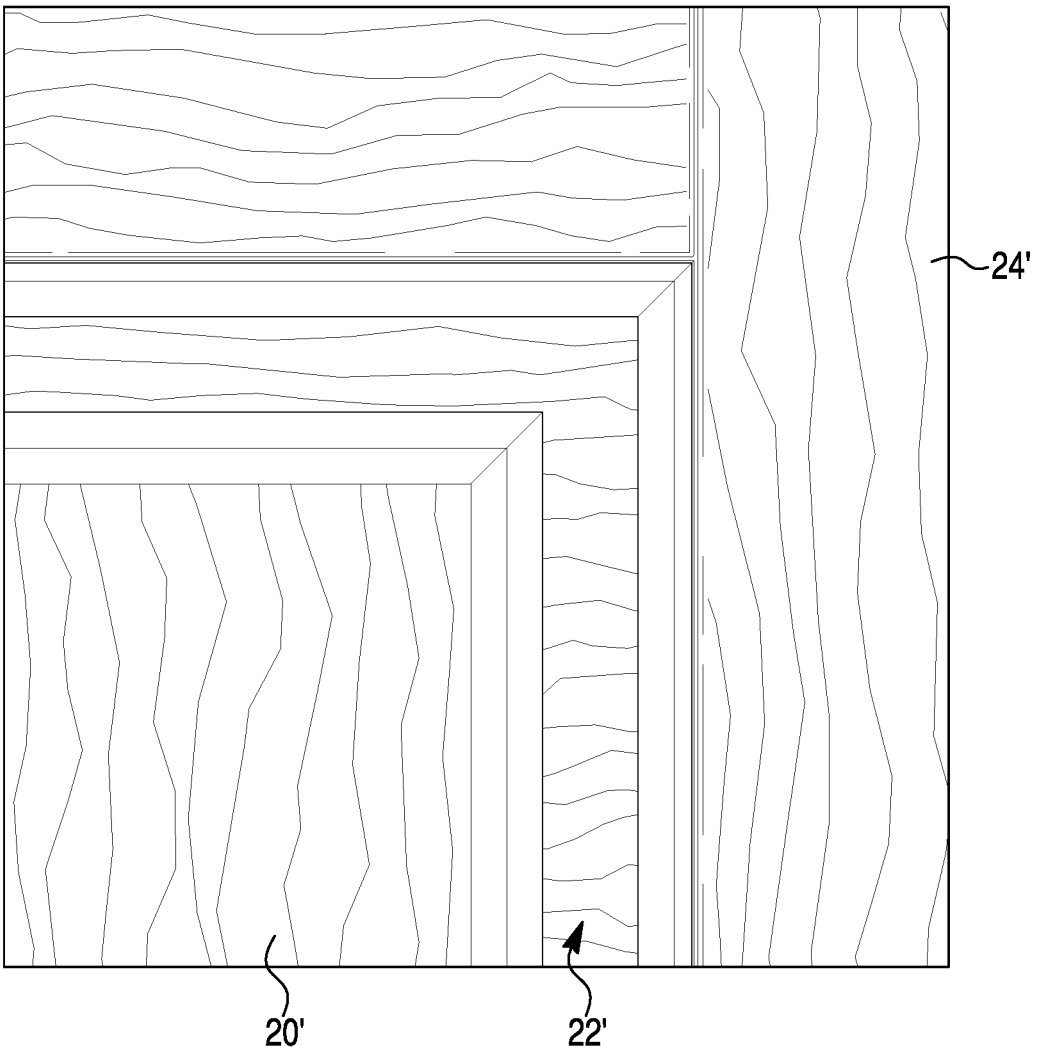
FIG. 16 is an enlarged, fragmented, elevational view of the front exterior surface of the door skin taken within box 16 of FIG. 18.
Figure 17:
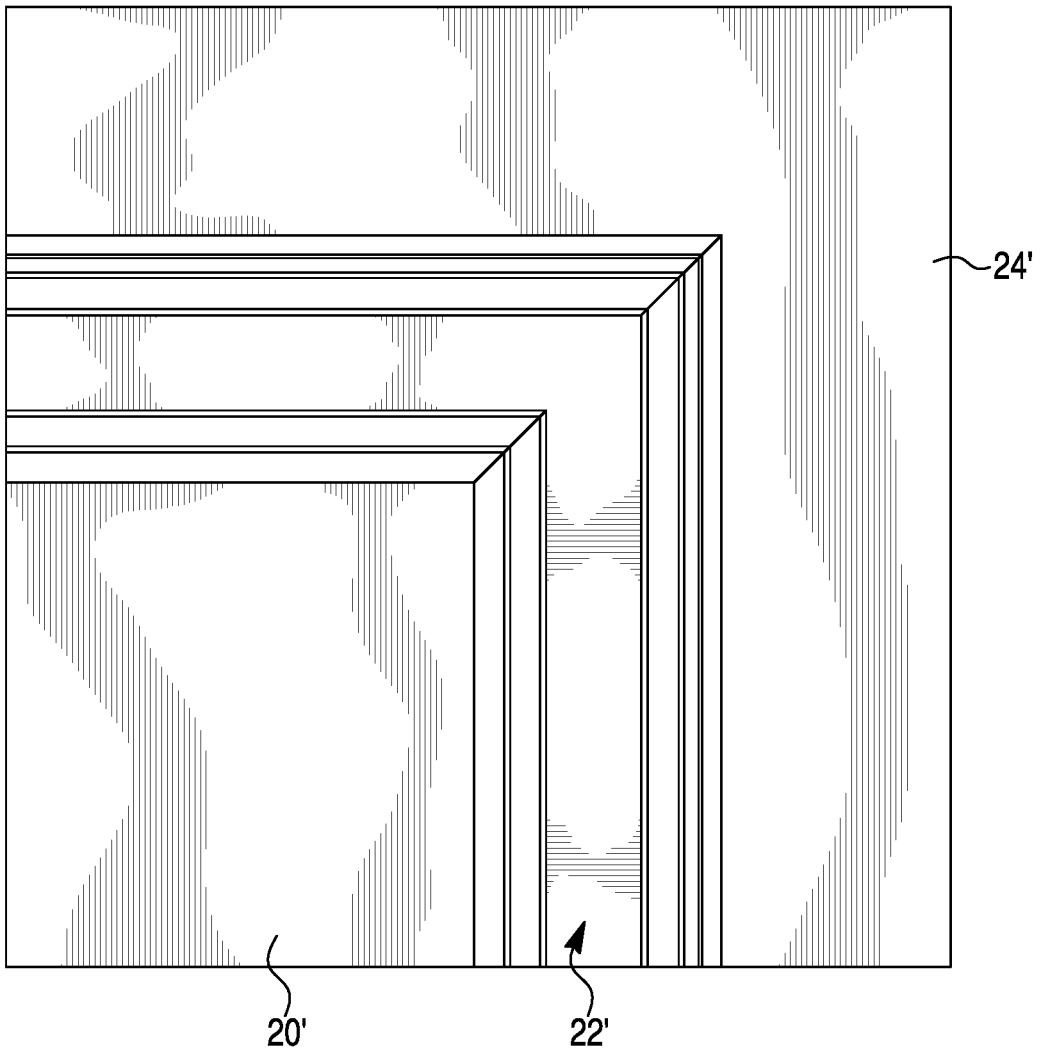
FIG. 17 is an enlarged, fragmented, elevational view of a rear exterior surface of the front exterior surface fragmented view of FIG. 16.
Figure 18:
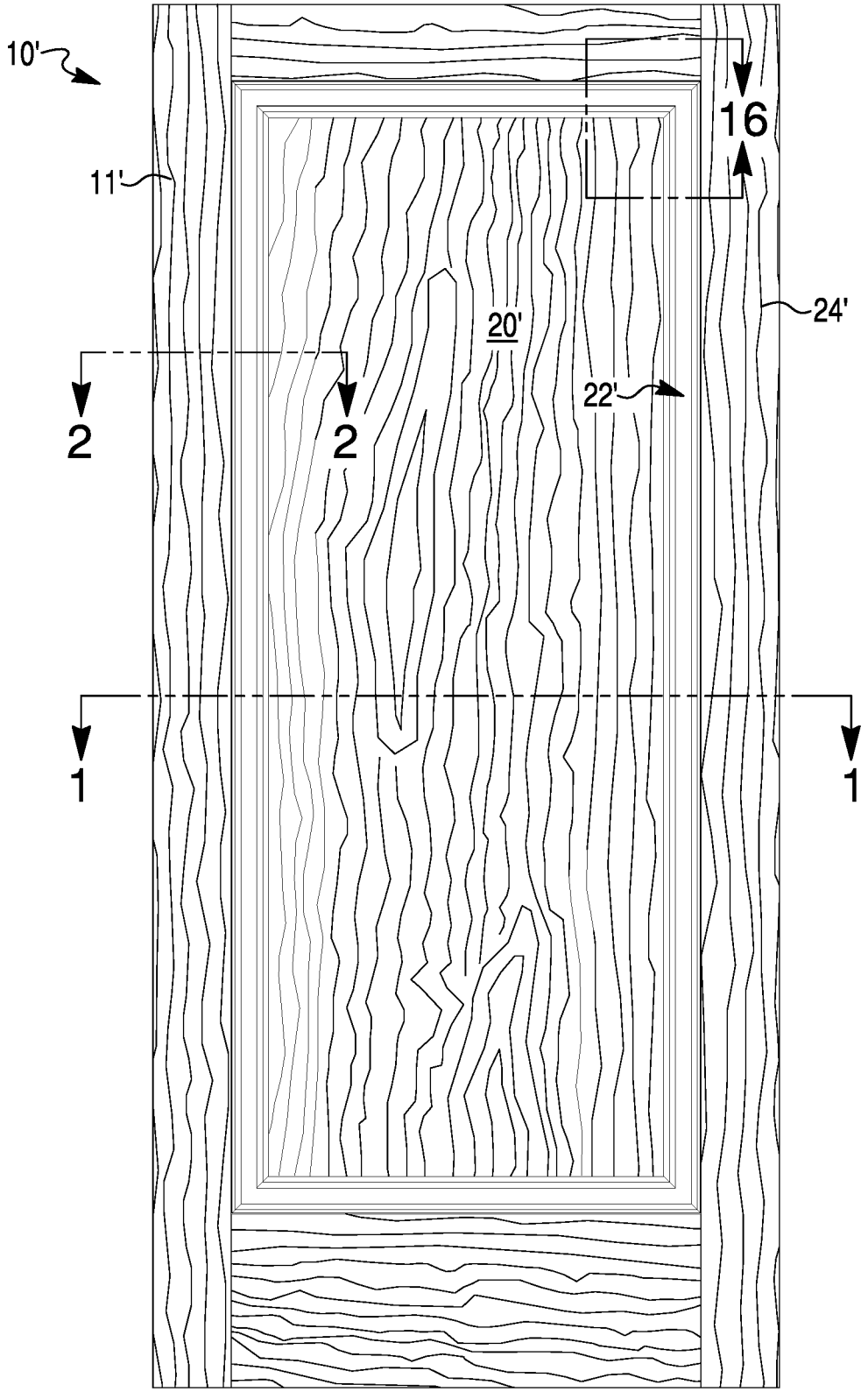
FIG. 18 is a front elevational view of a door skin according to a tenth embodiment of the invention.
Figure 19:
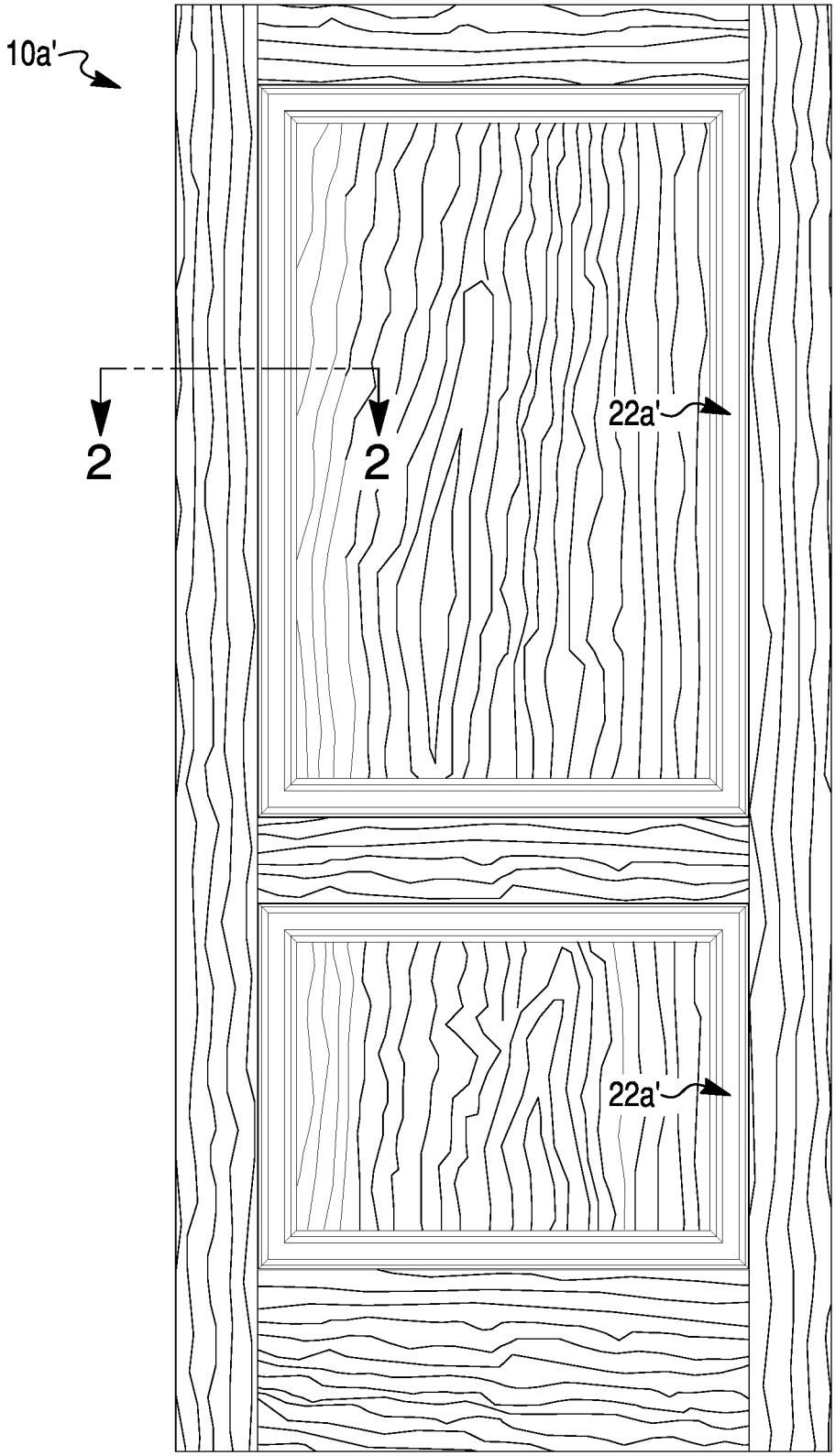
FIG. 19 is a front elevational view of a door skin according to an eleventh embodiment of the invention having a sectional profile region taken along sectional line 2-2 of FIG. 19 that is identical to the sectional profile region of FIG. 2.
Figure 20:
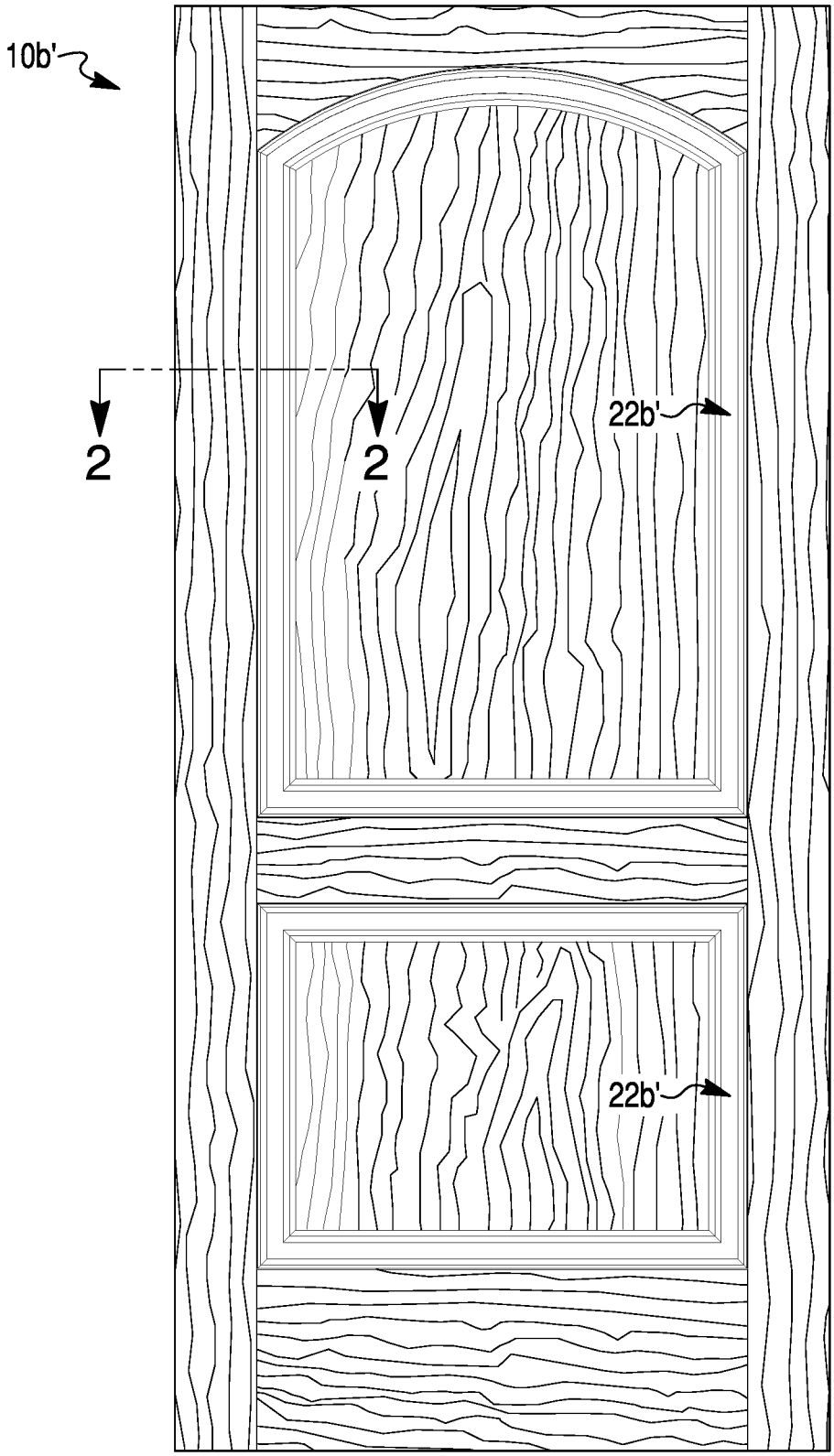
FIG. 20 is a front elevational view of a door skin according to a twelfth embodiment of the invention having a sectional profile region taken along sectional line 2-2 of FIG. 20 that is identical to the sectional profile region of FIG. 2.
Figure 21:
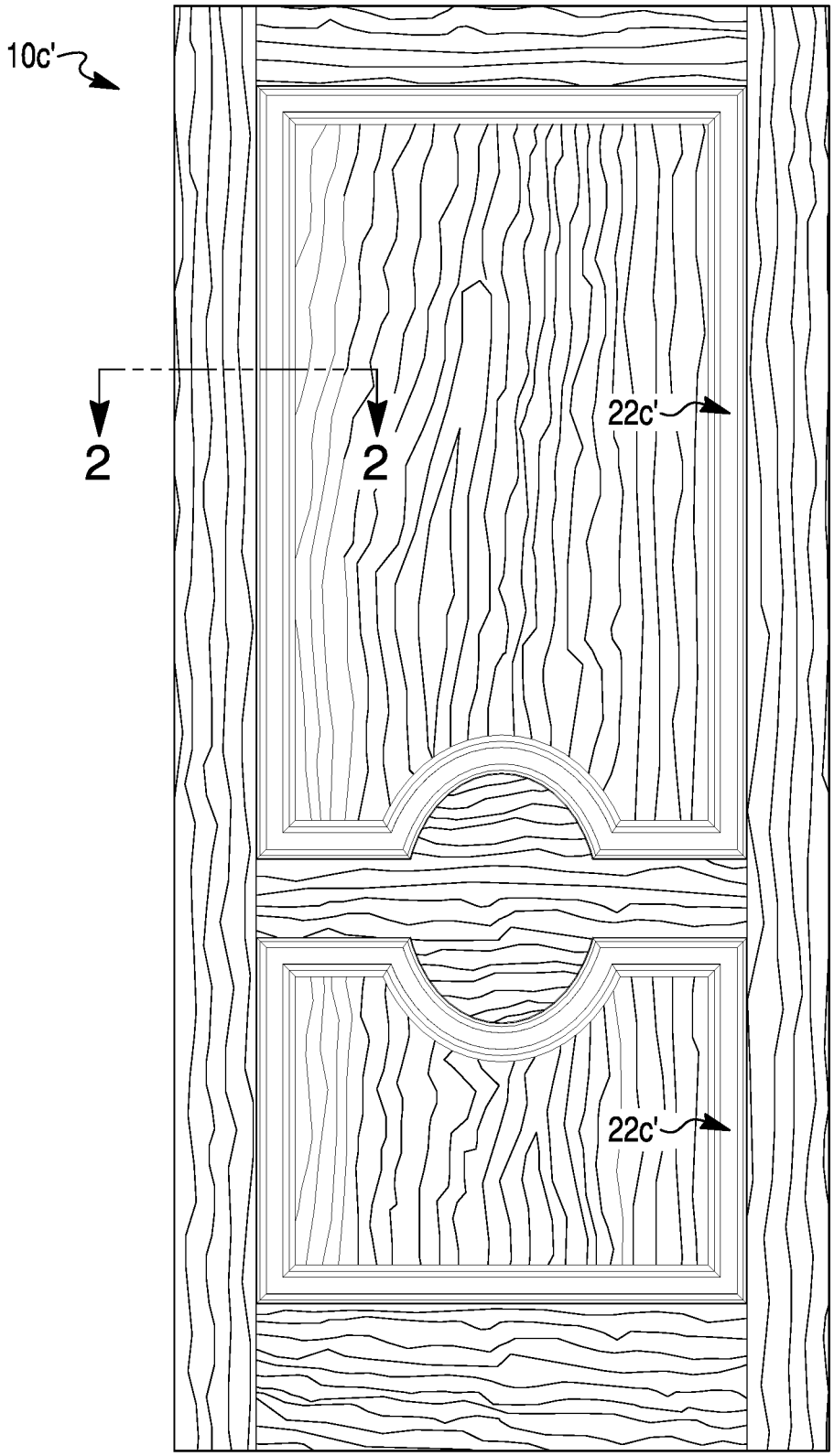
FIG. 21 is a front elevational view of a door skin according to a thirteenth embodiment of the invention having a sectional profile region taken along sectional line 2-2 of FIG. 21 that is identical to the sectional profile region of FIG. 2.
Figure 22:
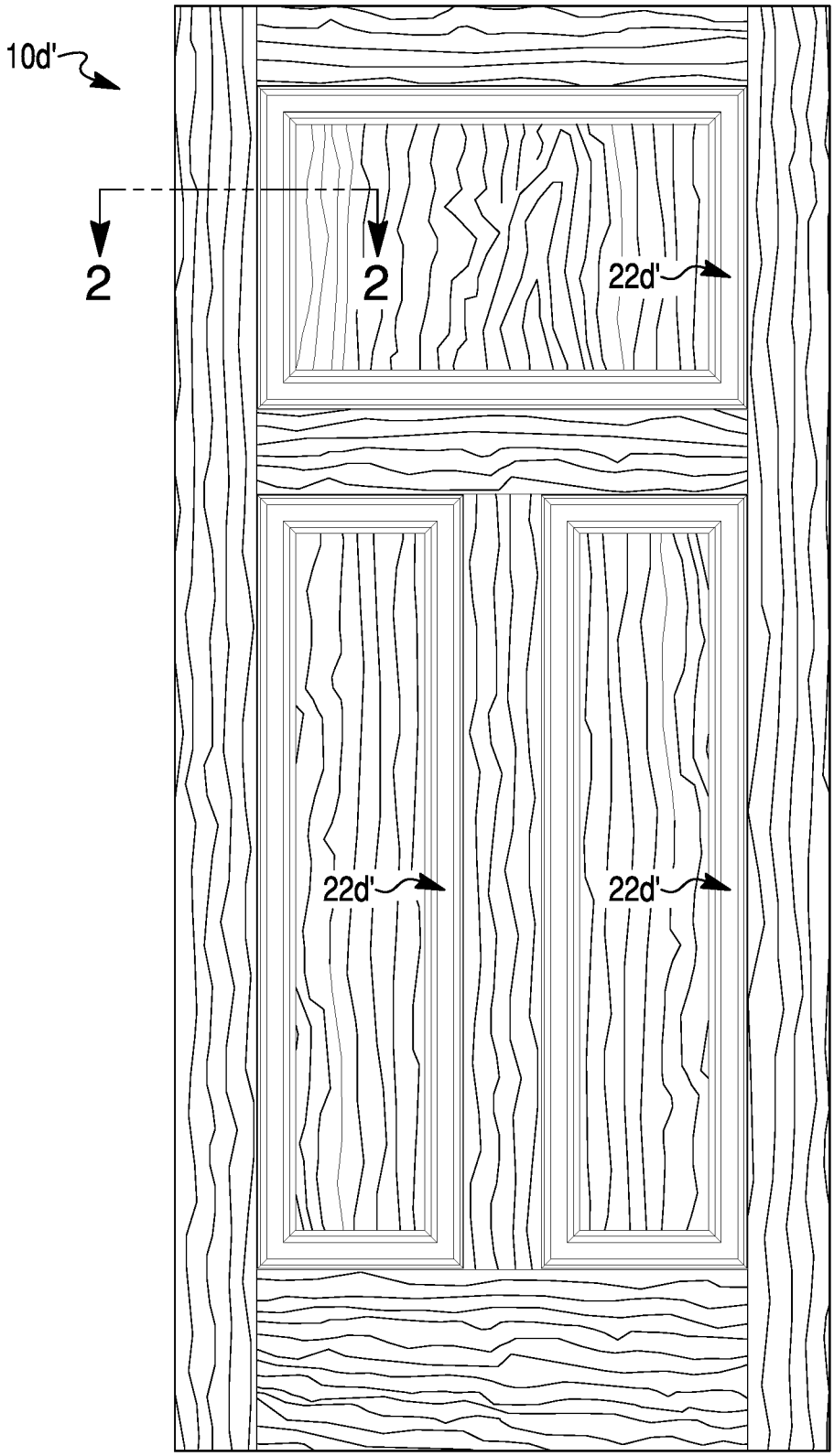
FIG. 22 is a front elevational view of a door skin according to a fourteenth embodiment of the invention having a sectional profile region taken along sectional line 2-2 of FIG. 22 that is identical to the sectional profile region of FIG. 2.
Figure 23:
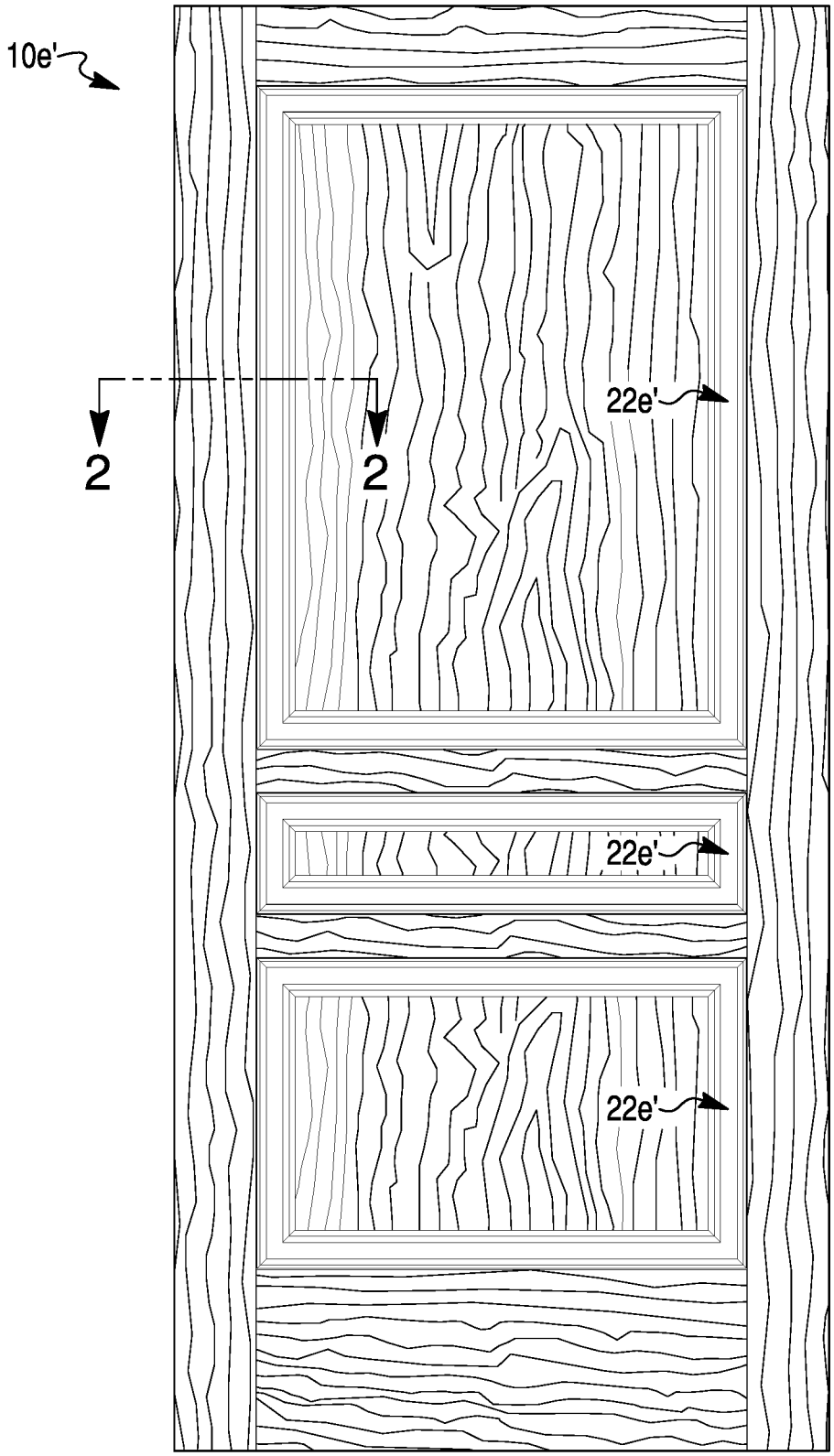
FIG. 23 is a front elevational view of a door skin according to a fifteenth embodiment of the invention having a sectional profile region taken along sectional line 2-2 of FIG. 23 that is identical to the sectional profile region of FIG. 2.
Figure 24:
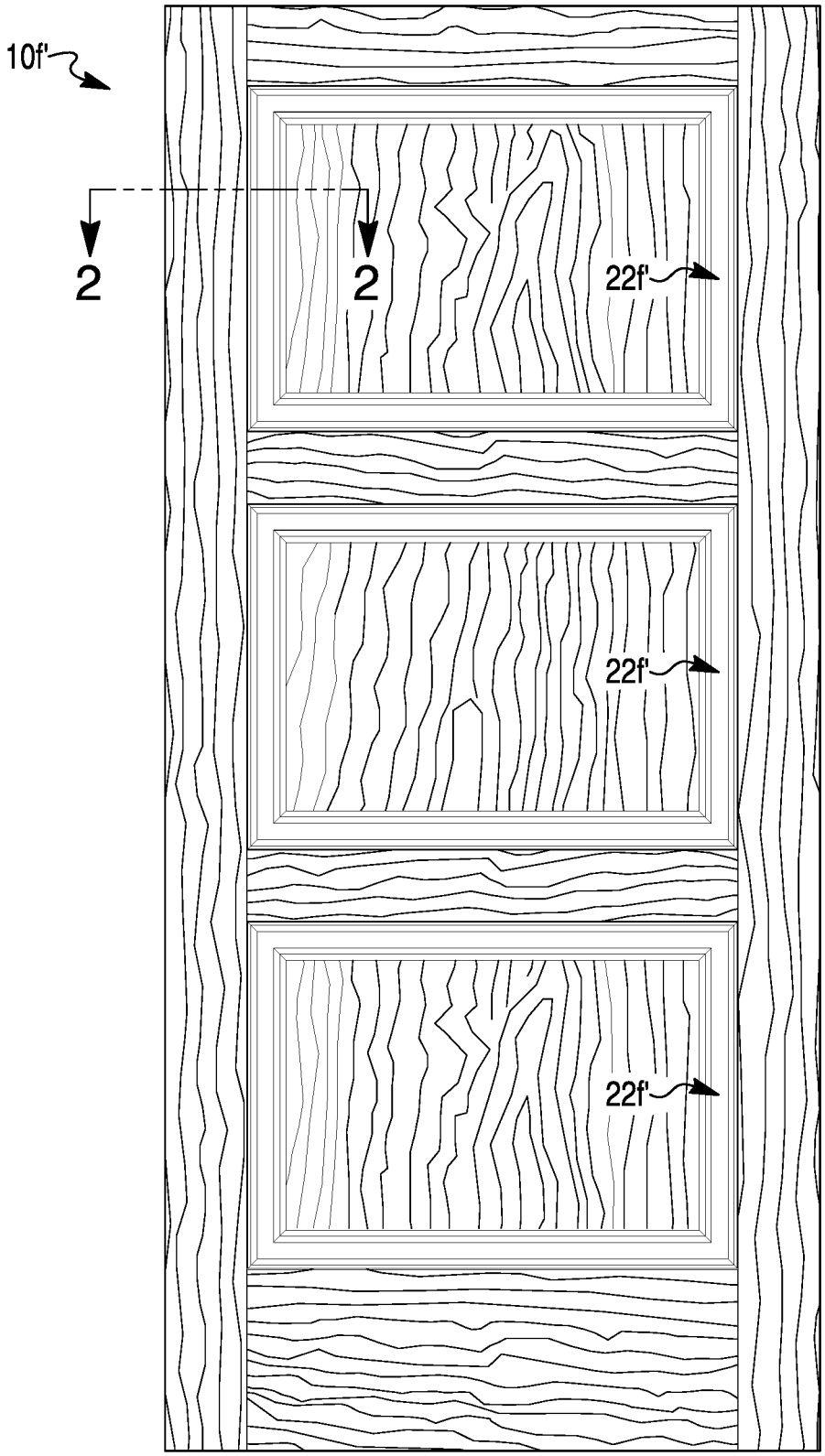
FIG. 24 is a front elevational view of a door skin according to a sixteenth embodiment of the invention having a sectional profile region taken along sectional line 2-2 of FIG. 24 that is identical to the sectional profile region of FIG. 2.
Figure 25:
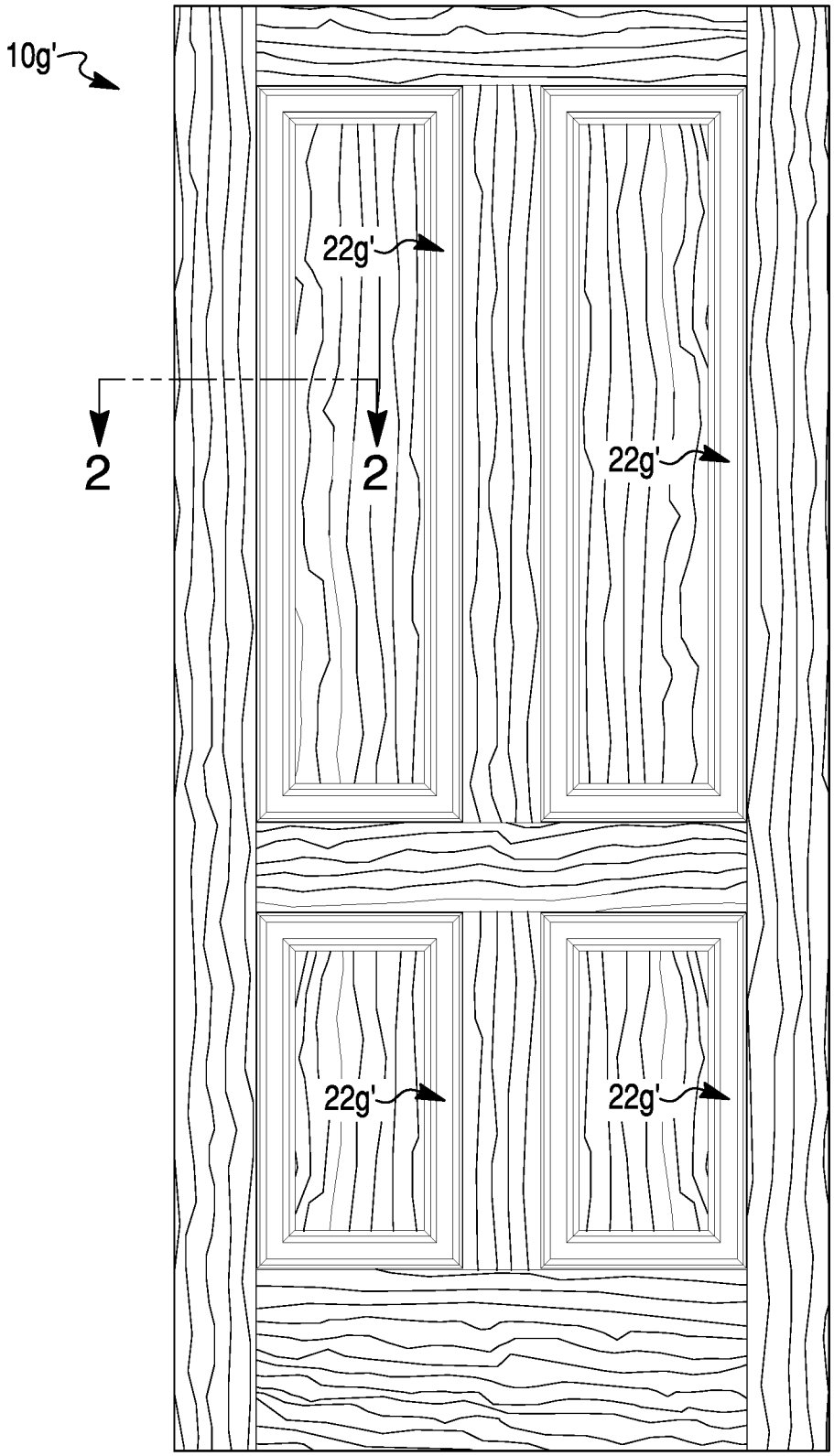
FIG. 25 is a front elevational view of a door skin according to a seventeenth embodiment of the invention having a sectional profile region taken along sectional line 2-2 of FIG. 25 that is identical to the sectional profile region of FIG. 2.
Figure 26:
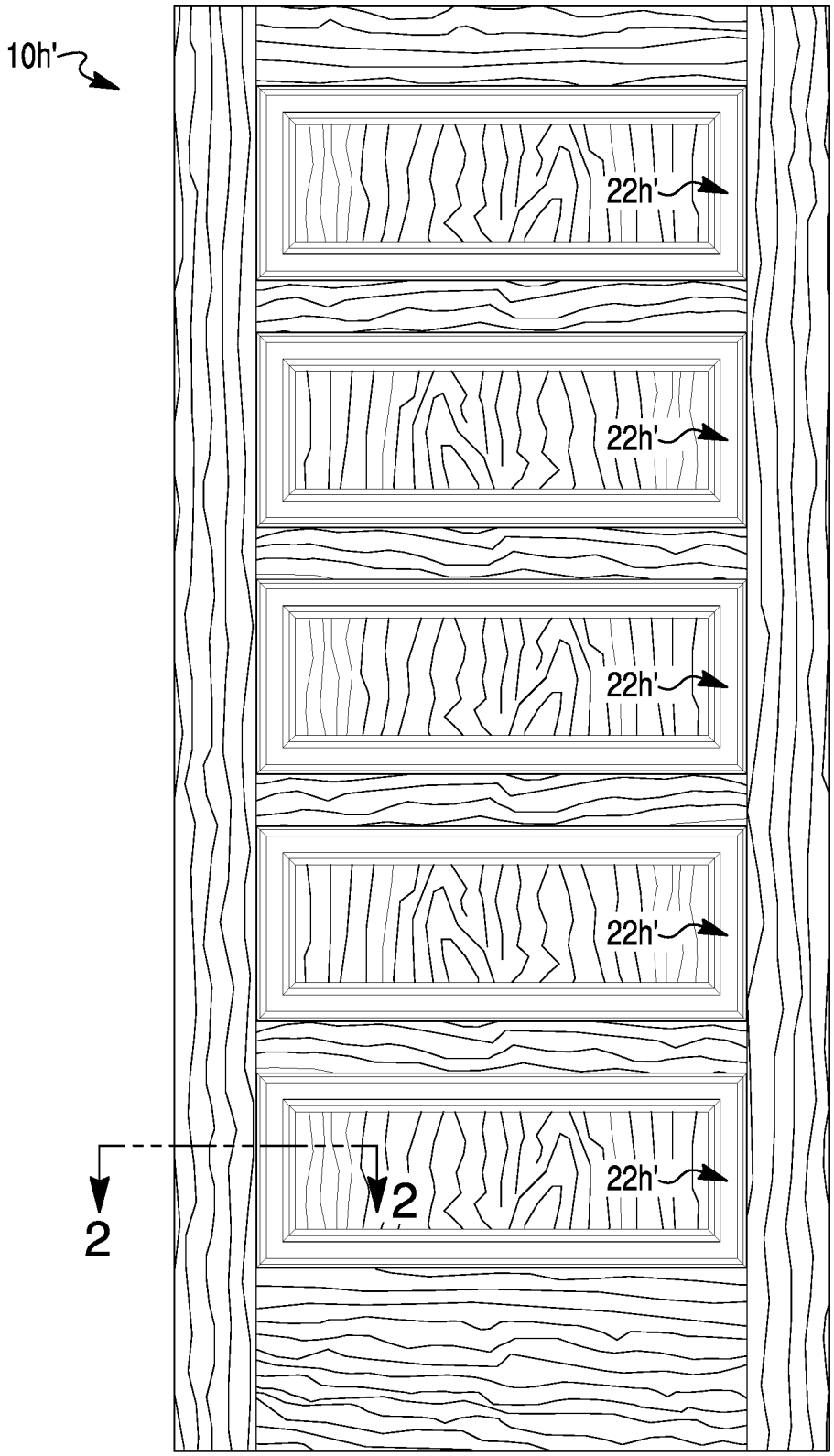
FIG. 26 is a front elevational view of a door skin according to an eighteenth embodiment of the invention having a sectional profile region taken along sectional line 2-2 of FIG. 26 that is identical to the sectional profile region of FIG. 2.

As best shown in FIG. 6, the single contoured portion 22 of the first embodiment has a continuous and uniform rectangular appearance from a front elevational viewpoint. FIGS. 7-14 illustrate exemplary embodiments of variations and modifications to the design of the door skins 11 and 14 that may be implemented. The continuous contoured portions 22*a*, 22*b*, 22*c*, 22*d*, 22*e*, 22*f*, 22*g*, and 22*h* of the door skins 10*a*, 10*b*, 10*c*, 10*d*, 10*e*, 10*f*, 10*g*, and 10*h* of each embodiment of FIGS. 7-14 have the same cross-sectional profile region as the contoured portion 22 of door skin 10 shown in FIG. 2. The cross-sectional profile extends continuously around the entire continuous contoured portions 22*a*, 22*b*, 22*c*, 22*d*, 22*e*, 22*f*, 22*g*, and 22*h*.

Figure 27:
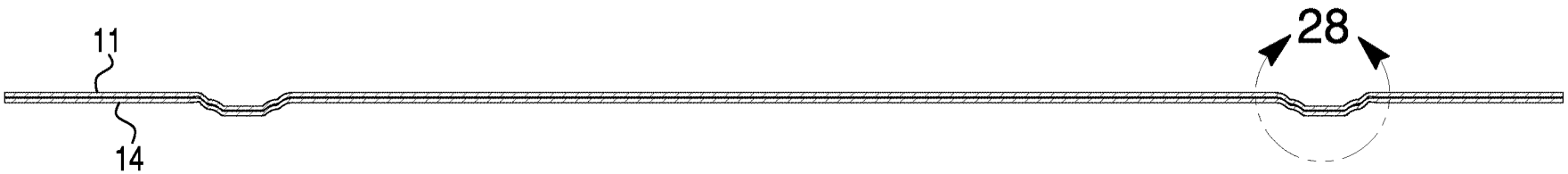
FIG. 27 is a cross-sectional view of a first door skin of the door of FIG. 1 stacked with an identical second door skin.

Referring now to FIGS. 27 and 28, the first door skin 11 is shown stacked on the second door skin 14, which has an identical profile to the first door skin 11. The second door skin 14 is inverted relative to its orientation in FIGS. 1 and 2. The description of the contours 22 above is incorporated herein by reference. For convenience, the suffix "a" is added to reference numerals associated with the first door skin 11 and the suffix "b" is added to reference numerals associated with the second door skin 14. FIGS. 27 and 28 show the exterior surfaces 12 and 15 facing upward; however, the door skins 11 and 14 may be stacked with the exterior surfaces 12 and 15 facing downward. Alternatively, the door skins 11, 14 may be nested/stacked on their side or end edges, for example, 90 degrees or 270 degrees from the position shown in FIGS. 27 and 28.

The first and second door skins 11 and 14 include first sloping portions 34*a* and 34*b*, respectively. An angled portion 38*a* of the first sloping portion 34*a* of the first door skin 11 is immediately adjacent to and within (or interior relative to) an outer body portion 24*a*. Likewise, an angled portion 38*b* of the first sloping portion 34*b* of the second door skin 14 is immediately adjacent to and within (or interior relative to) an outer body portion 24*b*. The interior surface 13 of the angled portion 38*a* of the first door skin 11 is above and in direct contact with the exterior surface 15 of the angled portion 38*b* of the second door skin 14. The angled portion 38*a* nests on the angled portion 38*b* to space the interior surface 13 of the outer body portion 24*a* of the first door skin 11 from the exterior surface 15 of the outer body portion 24*b* of the second door skin 14.

A first bump (or bead) 36*a* of the first sloping portion 34*a* of the first door skin 11 is immediately adjacent to and within (or interior to) the angled portion 38*a*. The exterior surface 12 of the first bump 36*a* extends convexly continuously from the angled portion 38*a* to a center base portion 30*a*. Likewise, a first bump (or bead) 36*b* of the first sloping portion 34*b* of the second door skin 14 is immediately adjacent to and within (or interior to) the angled portion 38*b*. The exterior surface 15 of the first bump 36*b* extends convexly continuously from the angled portion 38*b* to a center base portion 30*b*. The interior surface 13 of the first bump 36*a* contacts the exterior surface 15 of the first bump 36*b* of the second door skin 14 while the skins 11 and 14 are stacked or nested, as best shown in FIG. 28. The first bump 36*a* and the angled portion 38*a* intersect at a vertex 40*a*, and the first bump 36*b* and the angled portion 38*b* intersect at a vertex 40*b*.

The center base portion 30*a* of the first door skin 11 is immediately adjacent to and positioned within the first bump 36*a*. The center base portion 30*a* is substantially parallel to the outer body portion 24*a* and an inner panel 20*a* of the first door skin 11. The exterior surface 12 of the outer body portion 24*a* and the inner panel 20*a* are coplanar with one another. Likewise, the central based portion 30*b* of the second door skin 14 is immediately adjacent to and positioned within the first bump 36*b*. The center base portion 30*b* of the second door skin 14 is substantially parallel to the outer portion 24*b* and an inner panel 20*b* of the second door skin 14. The exterior surface 15 of the outer body portion 24*b* and the inner panel 20*b* are coplanar with one another.

In the nested position shown in FIGS. 27 and 28, the central base portions 30*a* and 30*b* are parallel and spaced relative to one another.

The first and second door skins 11 and 14 include second sloping portions 32*a* and 32*b*, respectively. A second bump (or bead) 42*a* of the second sloping portion 32*a* of the first door skin 11 is immediately adjacent to and within (or interior to) the central base portion 30*a*. Likewise, a second bump (or bead) 42*b* of the second sloping portion 32*b* of the second door skin 14 is immediately adjacent to and within or interior to the central base portion 30*b*. The interior surface 13 of the second bump 42*a* contacts the exterior surface 15 of the second bump 42*b* of the second door skin 14 while the skins 11 and 14 are stacked or nested.

The second sloping portion 32*a* of the first door skin 11 further includes a third bump (or bead) 44*a* immediately adjacent to and within (or interior to) the second bump 42*a*, such that the second bump 42*a* and the third bump 44*a* meet at a V-shaped intersection 46*a*. Likewise, the second sloping portion 32*b* of the second door skin 14 further includes a third bump (or bead) 44*b* immediately adjacent to and within or interior to the second bump 42*b*, such that the second bump 42*b* and the third bump 44*b* meet at a V-shaped intersection 46*b*. The interior surface 13 of the third bump 44*a* of the first door skin 11 contacts the exterior surface 15 of the third bump 44*b* of the second door skin 14 while the skins 11 and 14 are stacked or nested.

The exterior surface 12 of the second bump 42*a* of the first door skin 11 extends convexly continuously from the central base portion 30*a* to the third bump 44*a*, and the exterior surface 15 of the second bump 42*b* of the second door skin 14 extends convexly continuously from the central base portion 30*b* to the third bump 44*b*. The exterior surface 12 of the third bump 44*a* of the first door skin 11 extends convexly continuously from the second bump 42*a* to the inner panel 20*a*, and the exterior surface 15 of the third bump 44*b* of the second door skin 14 extends convexly continuously from the second bump 42*b* to the inner panel 20*b*.

The inner panel 20*a* of the first door skin 11 is located at an opposite end of the second sloping portion 32*a*. Similarly, the inner panel 20*b* of the second door skin 14 is located at an opposite end of the second sloping portion 32*b*. The interior surface 13 of the inner panel 20*a* is above and spaced from the exterior surface 15 of the inner panel 20*b*.

Although FIGS. 27 and 28 show two stacked door skins 11 and 14, it should be understood that three, four, five, six, or more (e.g., one hundred) door skins may be stacked with one another. Further, the different door designs described below, including in connection with FIGS. 7-26, may be stacked in a similar manner.

The nestable/stackable door skins 11, 14 allow for stacking of multiple door skins with one another, such as for shipping and storage, without the need for spacers. Preferably, nesting contact is limited to the relatively narrow beaded and angular portions 38*a*/38*b*, 36*a*/36*b*, 42*a*/42*b*, and 44*a*/44*b*, so that surface texture of the exterior surfaces of the larger area inner panels 20*a*/20*b* and the outer body portions 24*a*/24*b* is not adversely affected, such as by the movement of door skins 11 and 14 relative to one another during processing and shipping.

Also, the first and second door skins 11 and 14 may have thicknesses that vary over their lengths. For example, as best shown in FIG. 28, the first door skin 11 has a reduced thickness at the intersection of the outer body portion 24*a* and the angled portion 38*a*, and the second door skin 11 has a reduced thickness at the intersection of the outer body portion 24*b* and the angled portion 38*b*. These reduced-thickness zones may be established by forming recesses at the intersections, particularly at the interior surfaces 13 and 16 of the door skins 11 and 14. For example, for compression molded door skins, the recesses may be made by shaping the mold die surfaces to control caliper (or mold cavity thickness) so that the caliper is reduced at the aforementioned intersections. Those skilled in the art recognize that as thickness decreases, density increases and thus control of thickness affects the density of the door skins 11, 14. The external surfaces 12 and 15 of the door skins 11, 14 should be sufficiently hard (dense) in order to withstand impact, such as from contact with an article, etc.

While FIG. 6 illustrates an embodiment of a door skin 11 with one inner panel 20, the number of inner panels 20 may be varied. For example, the door skins 11 and 14 may have two inner panels with two contoured portions (e.g., the embodiments of FIGS. 7-9), three inner panels with three contoured portions (e.g., the embodiments of FIGS. 10-12), four inner panels with four contoured portions (e.g., the embodiment of FIG. 13), five inner panels with five contoured portions (e.g., the embodiment of FIG. 14), or more inner panels and associated contoured portions. The inner panels 20 may be arranged in vertically stacked configurations (e.g., the inner panels of the embodiments of FIGS. 7-9, 11, 12, and 14), side-by-side juxtaposed configurations, or a combination of vertically stacked and side-by-side juxtaposed configurations (e.g., the inner panels of the embodiments of FIGS. 10 and 13). The perimeters of the inner panels may establish other shapes, such as other polygons, circles, ovals, etc. The inner panels may have the same shapes (e.g., the inner panels of FIGS. 12 and 14) or different shapes (e.g., the inner panels of FIGS. 7-11 and 13) and/or dimensions from one another.

The door skins 11 and 14 may have a different arrangement of inner panels and other surface features (e.g., embossed wood grain) on their respective exterior surfaces 12 and 15 than shown in FIGS. 1-6. FIGS. 15-18 illustrates a door 10' that has an identical inner panel arrangement to the door 10 of FIGS. 1-6, except for the addition of wood grain pattern surface features in the exterior surface of the door skins. The door 10' includes a first door skin 11' and a second door skin (not shown in FIGS. 15-18 but identical to the second door skin 14 but with a wood grain pattern added). The first door skin 11' has a first exterior surface and an opposite first interior surface. Likewise, the second door skin has a second exterior surface and an opposite second interior surface. The first and second door skins of the embodiment of FIGS. 15-18 are each a one-panel skin having an inner panel 20', an outer body portion or outer skirt 24' surrounding the inner panel 20', and a contoured portion or ovalo 22' interconnecting and integrally formed as a unitary piece with the inner panel 20' and the outer body portion 24'. When viewed from the exterior side of the door skin 11', the contoured portion 22' defines a continuous depression extending into the planar portions of the exterior surface toward the door core. The contoured portion 22' has a sectional profile taken along sectional lines 1-1 and 2-2 of FIG. 18 that is identical to the sectional profile of FIGS. 1 and 2.

FIGS. 19-26 illustrate doors 10*a*', 10*b*', 10*c*', 10*d*', 10*e*', 10*f*', 10*g*', and 10*h*', respectively, having door skins including inner panel arrangements with encircling contoured portions 22*a*', 22*b*', 22*c*', 22*d*', 22*e*', 22*f*', 22*g*', and 22*h*', that are identical to FIGS. 7-14, respectively, except that the exterior surfaces of the door skins of the doors 10*a*', 10*b*', 10*c*', 10*d*', 10*e*', 10*f*', 10*g*', and 10*h*' of FIGS. 19-26 are provided with wood grain patterns. Those skilled in the art will understand that the wood grain pattern may be applied or formed also with the profile portions 22*a*', 22*b*', 22*c*', 22*d*', 22*e*', 22*f*, 22*g*', and 22*h*'.

The door skins with woodgrain exterior surfaces of FIGS. 15-26 can be stacked and nested with one another in the same manner described above in connection with FIGS. 27 and 28, or may be rotated, for example, 90, 180, or 270 degrees, from the manner shown in FIGS. 27 and 28, to rest on the side edges or end edges. The woodgrain embossing or molding does not adversely affect nesting. Stacking and nesting may involve placing the door skins on their side or end edges, i.e., perpendicular to the orientation shown in FIGS. 27 and 28.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to necessarily limit the invention to the precise embodiments disclosed.

What is claimed is:

1. A method for stacking doors skins, comprising the steps of a) providing a first door skin and a second door skin, each of the first and second door skins having an exterior surface and an interior surface, and comprises
   i) an inner panel,
   ii) an outer body portion, and
   iii) a contoured portion interconnecting the inner panel to the outer body portion, the contoured portion is recessed from the inner panel and the outer body portion and includes a center base portion, a first sloping portion interconnecting the central base portion with the outer body portion, and a second sloping portion interconnecting the central base portion with the inner panel, the first sloping portion including a first angled portion that is adjacent to the outer body and a first bump having a first convex exterior surface that extends from the first angled portion to the center base portion, the second sloping portion including a second bump and a third bump, the second bump is adjacent to the center base portion and has a second convex exterior surface that extends from the center base portion to the third bump, the third bump is adjacent to the inner panel and has a third convex exterior surface that extends from the second bump to the inner panel; and b) stacking the first door skin on the second door skins with the interior surface of the first door skin contacting the exterior surface of the second door skin.

2. The method of claim 1, wherein step b comprises nesting the first and second door with one another with the interior surface of the first angled portion, the first bump, the second bump, and the third bump of the first door skin directly contacting the exterior surface of the first angled portion, the first bump, the second bump, and the third bump of the second door skin.

3. The method of claim 1, wherein step b comprises nesting the first and second door skins with one another with the interior surface of inner panel, the outer body portion, and the center base portion of the first door skin spaced from the exterior surface of the inner panel, the outer body portion, and the center base portion of the second door skin.

4. The method of claim 1, wherein step b comprises nesting the first and second door with one another with 1) the interior surface of the first angled portion, the first bump, the second bump, and the third bump of the first door skin directly contacting the exterior surface of the first angled portion, the first bump, the second bump, and the third bump of the second door skin, and 2) the interior surface of inner panel, the outer body portion, and the center base portion of the first door skin spaced from the exterior surface of the inner panel, the outer body portion, and the center base portion of the second door skin.

5. The method of claim 1, wherein the first and second bumps are symmetrical with one another.

6. The method of claim 1, wherein the second sloping portion comprises the second and third bumps.

7. The method of claim 1, wherein the exterior surface of the first angled portion is planar.

8. The method of claim 1, wherein each door skin comprises a wood composite composition.

9. The method of claim 1, wherein each door skin comprises a fiberglass-reinforced polymer.

10. The method of claim 1, wherein the at least one contoured portion is formed as a unitary piece with the inner panel and the outer body portion.

11. The method of claim 1, wherein the exterior surface of the inner panel and the outer body portion are coplanar.

12. The method of claim 1, wherein the second convex exterior surface of the second bump and the third convex exterior surface of the third bump intersect at an intersection having a V-shaped profile.

13. A method for stacking doors skins, comprising the steps of a) providing a plurality of door skins, each of the door skins has an exterior surface and an interior surface, and comprises
   i) an inner panel,
   ii) an outer body portion, and
   iii) a contoured portion interconnecting the inner panel to the outer body portion, the contoured portion is recessed from the inner panel and the outer body portion and includes a center base portion, a first sloping portion interconnecting the central base portion with the outer body portion, and a second sloping portion interconnecting the central base portion with the inner panel, the first sloping portion including a first angled portion that is adjacent to the outer body and a first bump having a first convex exterior surface that extends from the first angled portion to the center base portion, the second sloping portion including a second bump and a third bump, the second bump is adjacent to the center base portion and has a second convex exterior surface that extends from the center base portion to the third bump, the third bump is adjacent to the inner panel and has a third convex exterior surface that extends from the second bump to the inner panel; and b) stacking the plurality of door skins on each other with the interior surface of one of the plurality of door skins contacting the exterior surface of another of the plurality of door skins.

14. The method of claim 13, wherein step b comprises nesting the plurality of door skins with one another with the interior surface of the first angled portion, the first bump, the second bump, and the third bump of the one of the door skins directly contacting the exterior surface of the first angled portion, the first bump, the second bump, and the third bump of the other of the plurality of door skins.

15. The method of claim 13, wherein step b comprises nesting the plurality of door skins with one another with the interior surface of inner panel, the outer body portion, and the center base portion of the one of the door skins spaced from the exterior surface of the inner panel, the outer body portion, and the center base portion of the other of the plurality of door skins.

16. The method of claim 13, wherein step b comprises nesting the first and second door with one another with 1) the interior surface of the first angled portion, the first bump, the second bump, and the third bump of the one of the plurality of door skins directly contacting the exterior surface of the first angled portion, the first bump, the second bump, and the third bump of the other of the plurality of the door skins, and 2) the interior surface of inner panel, the outer body portion, and the center base portion of the one of the door skins spaced from the exterior surface of the inner panel, the outer body portion, and the center base portion of the other of the plurality of door skins.

17. The method of claim 13, wherein the first and second bumps are symmetrical with one another.

18. The method of claim 13, wherein the second sloping portion comprises the second and third bumps.

19. The method of claim 13, wherein the exterior surface of the first angled portion is planar.

20. The method of claim 13, wherein each door skin comprises a wood composite composition.

* * * * *